US007469519B2

(12) United States Patent
Barthel et al.

(10) Patent No.: US 7,469,519 B2
(45) Date of Patent: Dec. 30, 2008

(54) PROCESS FOR PRODUCING A WATER-SOLUBLE PACKAGE CONTAINING A COMPOSITION

(75) Inventors: Wolfgang Barthel, Langenfeld (DE); Birgit Burg, Alpen (DE); Arno Düffels, Düsseldorf (DE); Salvatore Fileccia, Oberhausen (DE); Maren Jekel, Willich (DE); Christian Nitsch, Düsseldorf (DE); Ulf Arno Timmann, Köln (DE)

(73) Assignee: Henkel Kommanditgesellschaft auf Aktien (Henkel KGaA), Dusseldorf (DE)

( * ) Notice: Subject to any disclaimer, the term of this patent is extended or adjusted under 35 U.S.C. 154(b) by 107 days.

(21) Appl. No.: 11/413,298

(22) Filed: Apr. 28, 2006

(65) Prior Publication Data

US 2006/0281839 A1 Dec. 14, 2006

Related U.S. Application Data

(63) Continuation of application No. PCT/EP2004/010708, filed on Sep. 24, 2004.

(30) Foreign Application Priority Data

Oct. 31, 2003 (DE) ..... 103 50 931
Dec. 5, 2003 (DE) ..... 103 56 769

(51) Int. Cl.
*B65B 31/02* (2006.01)
*B65B 47/00* (2006.01)
*C11D 17/04* (2006.01)

(52) U.S. Cl. ..... 53/433; 53/453; 53/471; 206/524.7; 510/296; 510/439

(58) Field of Classification Search ..... 53/433, 53/453, 471, 511, 559, 561, 281; 206/524.7; 510/296, 439
See application file for complete search history.

(56) References Cited

U.S. PATENT DOCUMENTS 2,110,012 A 3/1938 Auban
3,208,192 A * 9/1965 Schaefer ..... 53/433
3,657,857 A 4/1972 De Woskin et al.
5,224,601 A * 7/1993 Gouge et al. ..... 206/524.7
7,013,623 B2 * 3/2006 Fisher et al. ..... 53/453
2003/0077005 A1 * 4/2003 Fisher et al. ..... 383/1
2003/0114333 A1 6/2003 Somerville-Roberts et al.

FOREIGN PATENT DOCUMENTS

| | | |
|---|---|---|
| DE | 27 06 114 | 8/1978 |
| DE | 37 22 214 | 1/1989 |
| DE | 203 12 512 | 12/2003 |
| GB | 2 361 685 | 10/2001 |
| GB | 2 362 868 | 12/2001 |
| NL | 1002658 | 9/1997 |
| WO | WO 93/08091 | 4/1993 |
| WO | WO 01/36290 | 5/2001 |
| WO | WO 02/16206 | 2/2002 |

OTHER PUBLICATIONS

Rompp Chemie Lexikon, 9th ed., George Thieme Verlag Stuttgart, New York, (1990), p. 2507.
Rompp Chemie Lexikon, 9th ed., George Thieme Verlag Stuttgart, New York, (1991), p. 3168.
Rompp Chemie Lexikon, 9th ed., George Thieme Verlag Stuttgart, New York, vol. 6, p. 4440, (1992).
Voigt Lehrbuch der pharmazeutischen Technologie [Textbook of pharmaceutical technology], 6th ed., p. 182-184 (1987).

* cited by examiner

*Primary Examiner*—Stephen F Gerrity
(74) *Attorney, Agent, or Firm*—John S. Child, Jr.

(57) ABSTRACT

A process for producing a substance with a water-soluble packaging. The process comprises the following steps: a) a water-soluble material is deformed so as to embody a vessel; b) the vessel is filled with a filling material selected among the group comprising detergents, cosmetics, pharmaceuticals, body care products, auxiliary agricultural agents, adhesives, surface-treating agents, construction materials, dyes or food items; c) a water-soluble film web is applied to the filled container; d) the filled container and film web are sealed; and e) the sealed and filled container is finished. The inventive methods are characterized in that a negative pressure is generated in the filled container in the course of the process. In order to generate the negative pressure, the air located between the filling material and the water-soluble film web applied in step c) escapes at least in part through openings in the water-soluble film web applied in step c). The inventive methods make it possible to produce compact dosing units that have a reduced volume while being provided with improved optical and haptic properties.

7 Claims, No Drawings

PROCESS FOR PRODUCING A WATER-SOLUBLE PACKAGE CONTAINING A COMPOSITION

CROSS-REFERENCE TO RELATED APPLICATIONS

This application is a continuation under 35 U.S.C. § 365(c) and 35 U.S.C. § 120 of International Application PCT/EP2004/010708, filed Sep. 24, 2004, which is incorporated herein by reference in its entirety. This application also claims priority under 35 U.S.C. § 119 of German Applications DE 103 56 769.0, filed Dec. 5, 2003, and DE 103 509 31.3, filed Oct. 31, 2003, which are incorporated herein by reference in their entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The present application provides a packaging process for consumable goods. In particular, this application discloses processes for packaging consumable goods with water-soluble packaging materials. The process described is suitable, for example, for the packaging of fillings from the group of the washing or cleaning compositions, cosmetics, surface treatment compositions, pharmaceuticals, bodycare compositions, agrochemical assistants, adhesives, building materials, dyes or foods.

Consumable goods, for example, washing or cleaning compositions, are nowadays available to the consumer in various supply forms. In addition to powders and granules, this range also encompasses, for example, concentrates in the form of extruded or tableted compositions. These solid, concentrated or compacted supply forms differ by a reduced volume per metered unit and thus lower the costs of packaging and transport. Furthermore, the tablets satisfy the wish of the consumer for a simplified dosage routine.

As alternatives to the above-described particulate or compacted compositions, solid or liquid compositions which have a water-soluble or water-dispersible envelope have increasingly been described in the last few years. Like the tablets, these compositions feature simplified dosage, since they can be dosed together with the water-soluble envelope, but they secondly also simultaneously enable the formulation of liquid or pulverulent compositions which feature better dissolution and more rapid activity compared to the compacted fillings.

For the production and spatial configuration of these water-soluble packagings, a series of different processes are available to those skilled in the art. These processes include bottle-blowing, injection molding and different thermoforming processes. Compared to the tablets, the compositions produced by these processes generally feature improved dissolution properties, but the volume of these compositions per metered unit, owing to the lack of compaction, is at the same time greater than the volume of these tablets comparable in performance per metered unit. However, this increased volume gives rise to problems in the dosage of these compositions, for example, in the dosage of washing or cleaning compositions via the detergent drawer of washing machines or machine dishwashers. Associated with this increased volume, the packaged compositions produced by means of thermoforming processes, in particular, feature an unattractive appearance and tactile properties.

(2) Description of Related Art, Including Information Disclosed Under 37 C.F.R. §§ 1.97 and 1.98

The pouches are flaccid and not dimensionally stable; the packaging material exhibits creases and distortions visible to the naked eye. To solve this problem, WO 02/16206 (Reckitt Benckiser) discloses a process for producing inflated, water-soluble vessels in which the packaged ingredients include at least one substance which releases a gas after the pouch has been sealed and thus increases the internal pressure of the pouch. Such a process has the disadvantage that the packaged compositions have to comprise at least one substance releasing such a gas and, in the event of damage to the vessel, lose their advantageous appearance and tactile properties within a short time. Finally, a not inconsiderable part of the volume of a metered unit is taken up by a gas or gas mixture in these compositions.

BRIEF SUMMARY OF THE INVENTION

It was, therefore, an object of the present application to provide a process for packaging consumable goods from the field of washing or cleaning compositions, cosmetics, pharmaceuticals, bodycare compositions, agrochemical assistants, adhesives, surface treatment compositions, building materials, dyes or foods with water-soluble packaging materials, which enables the production of packaged compositions with minimized volume. The resulting compositions should still offer an appearance attractive to the consumer and should especially be tightly packed and dimensionally stable.

It has now been found that these objects can be achieved by a process for producing water-soluble vessels, in which a reduced pressure is generated in the water-soluble vessels in the course of the preparation process.

The invention is concerned with a process for producing a composition with water-soluble packaging, comprising the steps of:

a) reshaping a water-soluble material to form a vessel;
b) filling the vessel with a filling selected from the group of the washing or cleaning compositions, cosmetics, pharmaceuticals, bodycare compositions, agrochemical assistants, adhesives, surface treatment compositions, building materials, dyes or foods;
c) applying a water-soluble film web to the filled vessel;
d) sealing the filled vessel;
e) finishing the sealed and filled vessel, characterized in that, in the course of the process, a reduced pressure is generated in the filled vessel, this reduced pressure being generated by the air disposed between the filling and the water-soluble film web applied in step c) escaping at least partly through orifices in the water-soluble film web applied in step c).

In the context of the present application, "finishing" refers, for example, to the sealing of receiving chambers and/or the isolation of the receiving chambers.

To generate the reduced pressure required in the process according to the invention, suitable pumps are all of those known to the person skilled in the art for these purposes; especially preferred are the water-jet, liquid vapor-jet, water-ring and piston pumps usable for a coarse vacuum. However, for example, it is also possible with preference to use rotary vane pumps, rotary piston pumps, trochoid pumps and sorption pumps, and also so-called Roots pumps and cryopumps. For the establishment of a fine vacuum, preference is given to rotary vane pumps, diffusion pumps, Roots pumps, displacer pumps, turbomolecular pumps, sorption pumps, ion getter pumps (getters).

In a preferred embodiment of the process according to the invention, the reduced pressure generated in this preferred process variant is between −100 and −1013 mbar, preferably between −200 and −1013 mbar, more preferably between −400 and −1013 mbar and, in particular, between −800 and −1013 mbar.

In a first preferred process variant, the reduced pressure in the filled vessel is generated after the application of the water-soluble film web to the filled vessel in step c) and before the sealing in step d).

In a further preferred process variant, the reduced pressure in the filled vessel is generated after the sealing in step d) and before the finishing in step e).

Particular preference is given to processes according to the invention in which the reduced pressure is generated both within the filled vessels, i.e. below the film web applied in step c), and outside the filled vessel, above the film web applied in step c). Such a particularly advantageous process can be implemented, for example, by filling the water-soluble material reshaped to form a vessel with a composition and then covering this filling by applying a water-soluble film web. The filled and covered vessel is subsequently placed into a reduced-pressure chamber. Owing to the orifices present in the water-soluble film web applied, application of a vacuum to the reduced-pressure chamber generates a reduced pressure, both in the filled vessels, i.e. below the film web applied in step c) and outside the filled vessel, above the film web applied in step c), since the air present below the film web applied in step c) passes through these orifices into the space above the film web applied in step c) and is removed from the reduced-pressure chamber from there by the vacuum applied. In a subsequent process step, the film web applied in step c) is sealed with the filled vessel such that the vessel is enclosed on all sides, and, in particular, air can no longer pass through the orifices of the film web applied in step c) into the vessel. When the sealed vessel is then removed from the reduced-pressure chamber, the atmospheric pressure acting on the vessel from outside has the effect that the outer walls of the vessel, especially the film web applied in step c) tightly adjoins the filling.

BRIEF DESCRIPTION OF THE SEVERAL VIEWS OF THE DRAWING(S)

Not Applicable.

DETAILED DESCRIPTION OF THE INVENTION

The present application therefore further preferably provides a process comprising the steps of:

a) reshaping a water-soluble material to form a vessel;

b) filling the vessel with a filling selected from the group of the washing or cleaning compositions, cosmetics, pharmaceuticals, bodycare compositions, agrochemical assistants, adhesives, surface treatment compositions, building materials, dyes or foods;

c) applying a water-soluble film web to the filled vessel;

d) placing the vessel covered with the film web into a reduced-pressure chamber and forming a reduced pressure in this chamber;

e) sealing the filled vessel;

f) releasing the reduced pressure in the reduced-pressure chamber;

g) finishing the sealed and filled vessel, characterized in that the formation of a reduced pressure in step d) generates a reduced pressure both in the filled vessel, i.e. below the film web applied in step c), and outside the filled vessel, above the film web applied in step c), the air disposed between the filling and the water-soluble film web applied in step c) escaping at least partly through orifices in the water-soluble film web applied in step c).

This particularly preferred process variant enables the production of compact and dimensionally stable portion packages with low volume. The sealing of the vessel in step e) preferably seals the vessel completely on all sides. The sealing can be effected in various ways. Particular preference is given to heat-sealing processes. In the sealing, it is especially preferred that the orifices of the water-soluble film web applied in step c) are sealed, i.e. welded, by the sealing process, or separated from the interior of the vessel by the seal seam. In the latter case, the orifices, after the sealing, are outside the seal seam and can be removed in the isolation together with the surrounding film material, for example, in the course of finishing.

In a preferred embodiment of the above-described process variant, the vessel is only partly filled in step b). Preference is given in this context to processes in which the fill level of the vessel after the filling is between 10 and 95% by volume, preferably between 20 and 90% by volume and, in particular, between 40 and 80% by volume. After the release of the reduced pressure in step f), the water-soluble film web is forced into the vessel owing to the action of atmospheric pressure and tightly adjoins the filling there. In this way, a first separated receiving chamber in the bottom region of the vessel is formed in the vessel, above which is disposed the residual volume of the water-soluble vessel from step a) unfilled in step b) and to which a second filling can be introduced in a further filling operation. This second filling can then be covered and sealed again with a sealing film. The resulting products feature a 2-phase appearance, the two chambers formed being separated from one another by the water-soluble film web applied in step c). When the second filling again only partly fills the water-soluble vessel formed in step a) and the second sealing is again effected in a reduced-pressure chamber by the above-described process, it is possible by the process according to the invention to produce compact washing or cleaning compositions with 3-phase appearance and three separate receiving chambers. The present application therefore further provides a process comprising the steps of a) reshaping a water-soluble material to form a vessel;

b) partially filling the vessel with a filling selected from the group of the washing or cleaning compositions, cosmetics, pharmaceuticals, bodycare compositions, agrochemical assistants, adhesives, surface treatment compositions, building materials, dyes or foods;

c) applying a water-soluble film web to the partly filled vessel;

d) placing the vessel covered with the film web into a reduced-pressure chamber and forming a reduced pressure in this chamber;

e) sealing the partly filled vessel;

f) releasing the reduced pressure in the reduced-pressure chamber to form a first filled separated receiving chamber and a second unfilled receiving chamber which is disposed above this receiving chamber and substantially corresponds to the unfilled residual volume of the vessel formed in step a);

g) at least partially filling this residual volume with a filling selected from the group of the washing or cleaning compositions, cosmetics, pharmaceuticals, bodycare compositions, agrochemical assistants, adhesives, surface treatment compositions, building materials, dyes or foods;

h) optionally applying a water-soluble film web to the at least partly filled vessel;

i) finishing the sealed and filled vessel, characterized in that the formation of a reduced pressure in step d) generates a reduced pressure both in the filled vessel, i.e. below the film web applied in step c), and outside the filled vessel, above the film web applied in step c), the air disposed between the filling and the water-soluble film web applied in step c) escaping at least partly through orifices in the water-soluble film web applied in step c).

The products of this process are compact, portioned washing or cleaning composition portions with separate receiving chambers, and also a filled depression which is not surrounded by water-soluble material on all sides. When a water-soluble film web has been applied in step h), the process product is a compact, portioned washing or cleaning composition portion with two separate receiving chambers.

In a preferred embodiment of this process, after step h) and before the finishing, steps d) to f), but preferably steps d) to g) and, in particular, steps d) to h) are repeated. In other words, particular preference is given in the present application to processes comprising the steps of:

a) reshaping a water-soluble material to form a vessel;

b) partially filling the vessel with a filling selected from the group of the washing or cleaning compositions, cosmetics, pharmaceuticals, bodycare compositions, agrochemical assistants, adhesives, surface treatment compositions, building materials, dyes or foods;

c) applying a water-soluble film web to the filled partly vessel;

d) placing the vessel covered with the film web into a reduced-pressure chamber and forming a reduced pressure in this chamber;

e) sealing the partly filled vessel;

f) releasing the reduced pressure in the reduced-pressure chamber to form a first filled separated receiving chamber and a second unfilled receiving chamber which is disposed above this receiving chamber and substantially corresponds to the unfilled residual volume of the vessel formed in step a);

g) filling this residual volume with a filling selected from the group of the washing or cleaning compositions, cosmetics, pharmaceuticals, bodycare compositions, agrochemical assistants, adhesives, surface treatment compositions, building materials, dyes or foods;

h) applying a water-soluble film web to the at least partly filled vessel;

i) placing the vessel covered with the film web into a reduced-pressure chamber and forming a reduced pressure in this chamber;

j) sealing the partly filled vessel;

k) releasing the reduced pressure in the reduced-pressure chamber to form a first filled separated receiving chamber and a separate, filled, second receiving chamber disposed above this receiving chamber;

l) finishing the sealed and filled vessel, characterized in that the formation of a reduced pressure in steps d) and i) generates a reduced pressure both in the filled vessel, i.e. below the film web applied in step c) or step h), and outside the filled vessel, above the film web applied in step c) or in step h), the air disposed between the filling and the water-soluble film web applied in step c) escaping at least partly through orifices in the water-soluble film web applied in step c) or in step h). The products of this process are compact, portioned washing or cleaning composition portions with two separate receiving chambers.

The present application thus preferably further provides a process comprising the steps of a) reshaping a water-soluble material to form a vessel;

b) partially filling the vessel with a filling selected from the group of the washing or cleaning compositions, cosmetics, pharmaceuticals, bodycare compositions, agrochemical assistants, adhesives, surface treatment compositions, building materials, dyes or foods;

c) applying a water-soluble film web to the partly filled vessel;

d) placing the vessel covered with the film web into a reduced-pressure chamber and forming a reduced pressure in this chamber;

e) sealing the partly filled vessel;

f) releasing the reduced pressure in the reduced-pressure chamber to form a first filled separated receiving chamber and a second filled receiving chamber which is disposed above this receiving chamber and substantially corresponds to the unfilled residual volume of the vessel formed in step a);

g) at least partly filling this residual volume with a filling selected from the group of the washing or cleaning compositions, cosmetics, pharmaceuticals, bodycare compositions, agrochemical assistants, adhesives, surface treatment compositions, building materials, dyes or foods;

h) applying a water-soluble film web to the at least partly filled vessel;

i) placing the vessel covered with the film web into a reduced-pressure chamber and forming a reduced pressure in this chamber;

j) sealing the partly filled vessel;

k) releasing the reduced pressure in the reduced-pressure chamber to form a first filled separated receiving chamber and a separate, filled, second receiving chamber disposed above this receiving chamber, and an unfilled third receiving chamber which is disposed above this filled second receiving chamber and corresponds substantially to the unfilled residual volume of the vessel formed in step a);

l) at least partly filling this residual volume with a filling selected from the group of the washing or cleaning compositions, cosmetics, pharmaceuticals, bodycare compositions, agrochemical assistants, adhesives, surface treatment compositions, building materials, dyes or foods;

m) finishing the sealed and filled vessel, characterized in that the formation of a reduced pressure in steps d) and i) generates a reduced pressure both in the filled vessel, i.e. below the film web applied in step c) or step h), and outside the filled vessel, above the film web applied in step c) or in step h), the air disposed between the filling and the water-soluble film web applied in step c) escaping at least partly through orifices in the water-soluble film web applied in step c) or in step h). The products of this process are compact, portioned washing or cleaning composition portions with two separate receiving chambers and also a filled depression, the depression filling not being surrounded by a water-soluble material on all sides.

Finally, the present application further preferably provides a process, comprising the steps of:

a) reshaping a water-soluble material to form a vessel;

b) partially filling the vessel with a filling selected from the group of the washing or cleaning compositions, cosmetics, pharmaceuticals, bodycare compositions, agrochemical assistants, adhesives, surface treatment compositions, building materials, dyes or foods;

c) applying a water-soluble film web to the partly filled vessel;

d) placing the vessel covered with the film web into a reduced-pressure chamber and forming a reduced pressure in this chamber;

e) sealing the partly filled vessel;

f) releasing the reduced pressure in the reduced-pressure chamber to form a first filled separated receiving chamber and a second filled receiving chamber which is disposed above this receiving chamber and substantially corresponds to the unfilled residual volume of the vessel formed in step a);

g) at least partly filling this residual volume with a filling selected from the group of the washing or cleaning compositions, cosmetics, pharmaceuticals, bodycare compositions, agrochemical assistants, adhesives, surface treatment compositions, building materials, dyes or foods;

h) applying a water-soluble film web to the at least partly filled vessel;

i) placing the vessel covered with the film web into a reduced-pressure chamber and forming a reduced pressure in this chamber;

j) sealing the partly filled vessel;

k) releasing the reduced pressure in the reduced-pressure chamber to form a first filled separated receiving chamber and a separate, filled, second receiving chamber disposed above this receiving chamber, and an unfilled third receiving chamber which is disposed above this filled second receiving chamber and corresponds substantially to the unfilled residual volume of the vessel formed in step a);

l) at least partly filling this residual volume with a filling selected from the group of the washing or cleaning compositions, cosmetics, pharmaceuticals, bodycare compositions, agrochemical assistants, adhesives, surface treatment compositions, building materials, dyes or foods;

m) applying a water-soluble film web to the at least partly filled vessel;

n) finishing the sealed and filled vessel, characterized in that the formation of a reduced pressure in steps d) and i) generates a reduced pressure both in the filled vessel, i.e. below the film web applied in step c) or step h), and outside the filled vessel, above the film web applied in step c) or in step h), the air disposed between the filling and the water-soluble film web applied in step c) escaping at least partly through orifices in the water-soluble film web applied in step c) or in step h). The products of this process are compact, portioned washing or cleaning composition portions with three separate receiving chambers.

In the above-described process according to the invention and its advantageous variations, it is particularly preferred when all of the air disposed between the filling and the water-soluble film web applied in step c) escapes through orifices in the water-soluble film web applied in step c).

In the above-described processes, it is also particularly preferred to stabilize the vessels formed in step a) in their spatial shape after they have been placed into the reduced-pressure chamber, in order to prevent a collapse of the vessel as a result of the reduced pressure generated between filling and water-soluble film web. This is especially true of processes in which the vessels produced in step a) have a wall thickness below 800 μm, preferably below 600 μm, more preferably below 400 μm and especially below 200 μm. These prerequisites apply, for example, to those processes according to the invention in which the reshaping of the water-soluble material in step a) is effected by thermoforming of a water-soluble film web. In these processes, it is especially preferred to hold the vessel from below by means of a support mold during the action of the reduced pressure generated in the reduced-pressure chamber. It is particularly preferred to use, as the support mold, the thermoforming molds used in the thermoforming of the vessels or molds comparable to these molds or identical to these molds. In particular, it is preferred to generate a second reduced pressure between the support mold and the vessel to stabilize the vessel in the reduced-pressure chamber. This second reduced pressure is preferably between −100 and −1013 mbar, preferably between −200 and −1013 mbar, more preferably between −400 and −1013 mbar and, in particular, between −800 and −1013 mbar. It is especially preferred that this second reduced pressure formed between the support mold and the vessel is higher in magnitude than the reduced pressure formed in the reduced-pressure chamber.

The reshaping of the water-soluble material in step a) of the process according to the invention is effected preferably by injection molding or casting or thermoforming.

"Injection molding" refers to the reshaping of a molding material such that the material present in a material cylinder for more than one injection-molding operation is softened plastically under the action of heat and flows under pressure through a nozzle into the cavity of a mold closed beforehand. The process is employed mainly in the case of noncurable molding materials which solidify in the mold by cooling. Injection molding is a very economically viable, modern process for producing articles shaped without cutting and it is particularly suitable for automated mass production. In industrial operation, the thermoplastic molding materials (powder, particles, cubes, pastes, inter alia) are heated up to liquefaction (up to 180° C.) and then sprayed under high pressure (up to 140 MPa) into closed, two-part, i.e. consisting of die (formerly known as female part) and core (formerly known as male part), preferably water-cooled hollow molds, where they cool and solidify. It is possible to use piston and screw injection-molding machines.

"Thermoforming" refers to processes in which a film material is reshaped by the action of pressure to form a depression or receiving chamber. The action of pressure can be effected, for example, by the action of a plunger, by the action of compressed air and/or by the action of a reduced pressure. The action of pressure can be effected by two parts of a mold which behave like positive and negative to one another and reshape a film placed between these molds when they are pressed together. However, another suitable compressive force is the intrinsic weight of an active substance placed on the upper side of the film. Preference is given to effecting the reshaping in a mold which defines the final three-dimensional shape of the resulting depression or receiving chamber and enables the reproducible production of defined three-dimensional shapes. In the context of the present application, particular preference is given to processes in which the film material is shaped into the depression of a thermoforming mold by the action of a reduced pressure. After the thermoforming, the thermoformed film material is preferably fixed in its three-dimensional shape achieved by the thermoforming operation by use of a reduced pressure. Suitable pumps for the generation of the reduced pressure required are all pumps known to those skilled in the art for these purposes, especially the water-jet pumps, liquid vapor-jet pumps, water-ring pumps and piston pumps usable for a coarse vacuum. However, it is also possible to use, for example, rotary vane pumps, rotary piston pumps, trochoid pumps and sorption pumps, and also so-called Roots pumps and cryopumps. For the establishment of a fine vacuum, especially suitable are rotary vane pumps, diffusion pumps, Roots pumps, displacer pumps, turbomolecular pumps, sorption pumps, ion getter pumps (getters).

The film material used may be pretreated before or during the thermoforming. Such a pretreatment includes, for example, the action of heat and/or solvents and/or the conditioning of the film material by relative atmospheric moisture changed compared to ambient conditions. When the film material is pretreated by the action of heat, this material is preferably heated to temperatures above 60° C., preferably above 80° C., more preferably between 100 and 120° C. and, in particular, to temperatures between 105 and 115° C. for up to 5 seconds, preferably for from 0.001 to 4 seconds, more preferably for from 0.01 to 3 seconds and, in particular, for from 0.02 to 2 seconds. To remove this heat, it is preferred to cool the molds used and the receiving depressions present in these molds. The cooling is effected preferably to temperatures below 20° C., preferentially below 15° C., more preferably to temperatures between 2 and 14° C. and, in particular, to temperatures between 4 and 12° C. Especially suitable for cooling are cooling liquids, preferably water, which are circulated within special cooling lines within the mold.

The water-soluble material used in steps a) and/or c) of the process according to the invention preferably comprises a water-soluble polymer. Particular preference is given especially to film materials which consist fully or partly of polyvinyl alcohol or a cellulose ether such as hydroxypropylmethylcellulose (HPMC).

"Polyvinyl alcohols" (abbreviated "PVAL," occasionally also "PVOH") is the name for polymers of the general structure $$[—CH_2—CH(OH)—]_n$$

which also comprise structural units of the $$[—CH_2—CH(OH)—CH(OH)—CH_2]$$

incorporated in small portions.

Commercial polyvinyl alcohols, which are supplied as white-yellowish powders or granules with degrees of polymerization in the range from approximately 100 to 2500 (molar masses from approximately 4000 to 100 000 g/mol), have degrees of hydrolysis of 98-99 or 87-89 mol %, and thus also comprise a residual content of acetyl groups. The polyvinyl alcohols are characterized on the part of the manufacturer by specifying the degree of polymerization of the starting polymer, the degree of hydrolysis, the hydrolysis number or the solution viscosity.

Depending on the degree of hydrolysis, polyvinyl alcohols are soluble in water and a few strongly polar organic solvents (formamide, dimethylformamide, dimethyl sulfoxide); they are not attacked by (chlorinated) hydrocarbons, esters, fats and oils. Polyvinyl alcohols are classified as toxicologically safe and are at least partially biodegradable. The water solubility can be reduced by aftertreatment with aldehydes (acetalization), by complexing with nickel or copper salts or by treatment with dichromates, boric acid or borax. The coatings made of polyvinyl alcohol are largely impenetratable to gases such as oxygen, nitrogen, helium, hydrogen, carbon dioxide, but allow steam to pass through.

In the context of the present invention, preference is given to using packaging or coating materials which comprise at least in part a polyvinyl alcohol whose degree of hydrolysis is from 70 to 100 mol %, preferably from 80 to 90 mol %, more preferably from 81 to 89 mol % and, in particular, from 82 to 88 mol %. In a preferred embodiment, the film material used consists to an extent of at least 20% by weight, more preferably to an extent of at least 40% by weight, even more preferably to an extent of at least 60% by weight and, in particular, to an extent of at least 80% by weight of a polyvinyl alcohol whose degree of hydrolysis is from 70 to 100 mol %, preferably from 80 to 90 mol %, more preferably from 81 to 89 mol % and, in particular, from 82 to 88 mol %. Preferably, the entire film material used consists to an extent of at least 20% by weight, more preferably to an extent of at least 40% by weight, even more preferably to an extent of at least 60% by weight and, in particular, to an extent of at least 80% by weight of a polyvinyl alcohol whose degree of hydrolysis is from 70 to 100 mol %, preferably from 80 to 90 mol %, more preferably from 81 to 89 mol % and, in particular, from 82 to 88 mol %.

The film materials used are preferably polyvinyl alcohols of a certain molecular weight range, preference being given in accordance with the invention to the film material comprising a polyvinyl alcohol whose molecular weight is in the range from 10,000 to 100,000 $gmol^{-1}$, preferably from 11,000 to 90,000 $gmol^{-1}$, more preferably from 12,000 to 80,000 $gmol^{-1}$ and, in particular, from 13,000 to 70,000 $gmol^{-1}$.

The degree of polymerization of such preferred polyvinyl alcohols is between about 200 and about 2,100, preferably between about 220 and about 1,890, more preferably between about 240 and about 1,680 and, in particular, between about 260 and about 1,500. Preference is given in accordance with the invention to using film materials which comprise polyvinyl alcohols and/or PVAL copolymers whose average degree of polymerization is between 80 and 700, preferably between 150 and 400, more preferably between 180 and 300, and/or whose molecular weight ratio MG(50%) to MG(90%) is between 0.3 and 1, preferably between 0.4 and 0.8 and, in particular, between 0.45 and 0.6.

The polyvinyl alcohols described above are widely available commercially, for example, under the trade name Mowiol® (Clariant). Polyvinyl alcohols which are particularly suitable in the context of the present invention are, for example, Mowiol® 3-83, Mowiol® 4-88, Mowiol® 5-88 and Mowiol® 8-88, and also L648, L734, Mowiflex LPTC 221 ex KSE and the compounds from Texas Polymers, for example, Vinex 2034.

Further polyvinyl alcohols which are particularly suitable as a film material can be taken from the table below:

| Name | Degree of hydrolysis [%] | Molar mass [kDa] | Melting point [−C.] |
|---|---|---|---|
| Airvol ® 205 | 88 | 15-27 | 230 |
| Vinex ® 2019 | 88 | 15-27 | 170 |
| Vinex ® 2144 | 88 | 44-65 | 205 |
| Vinex ® 1025 | 99 | 15-27 | 170 |

-continued

| Name | Degree of hydrolysis [%] | Molar mass [kDa] | Melting point [–C.] |
|---|---|---|---|
| Vinex ® 2025 | 88 | 25-45 | 192 |
| Gohsefimer ® 5407 | 30-28 | 23-600 | 100 |
| Gohsefimer ® LL02 | 41-51 | 17-700 | 100 |

Further polyvinyl alcohols suitable as a material for the water-soluble or water-dispersible films are ELVANOL® 51-05, 52-22, 50-42, 85-82, 75-15, T-25, T-66, 90-50 (trademark of Du Pont), ALCOTEX® 72.5, 78, B72, F80/40, F88/4, F88/26, F88/40, F88/47 (trademark of Harlow Chemical Co.), Gohsenol® NK-05, A-300, AH-22, C-500, GH-20, GL-03, GM-14L, KA-20, KA-500, KH-20, KP-06, N-300, NH-26, NM11Q, KZ-06 (trademark of Nippon Gohsei K.K.). Also suitable are ERKOL types from Wacker.

The water content of preferred PVAL packaging materials is preferably less than 10% by weight, preferentially less than 8% by weight, more preferably less than 6% by weight and, in particular, less than 4% by weight.

The water solubility of PVAL can be altered by aftertreatment with aldehydes (acetalization) or ketones (ketalization). In this context, particularly preferred polyvinyl alcohols which are particularly advantageous due to their exceptionally good solubility in cold water have been found to be those which are acetalized or ketalized with the aldehyde and keto groups, respectively, of saccharides or polysaccharides or mixtures thereof. The reaction products of PVAL and starch can be used exceptionally advantageously.

In addition, the solubility in water can be altered by formulation of complexes with nickel or copper salts or by treatment with dichromates, boric acid, borax, and thus be adjusted in a controlled manner to desired values. Films of PVAL are largely impenetratable to gases such as oxygen, nitrogen, helium, hydrogen, carbon dioxide, but allow steam to pass through.

Examples of suitable water-soluble PVAL films are the PVAL films obtainable under the name "SOLUBLON®" from Syntana Handelsgesellschaft E. Harke GmbH & Co. Their solubility in water can be adjusted to a precise degree, and films of this product series are obtainable which are soluble in the aqueous phase in all temperature ranges relevant for the application.

Further preferred film materials are characterized in that they comprise hydroxypropylmethylcellulose (HPMC) which has a degree of substitution (average number of methoxy groups per anhydroglucose unit of the cellulose) of from 1.0 to 2.0, preferably from 1.4 to 1.9, and a molar substitution (average number of hydroxypropoxy groups per anhydroglucose unit of the cellulose) of from 0.1 to 0.3, preferably from 0.15 to 0.25.

The thickness of water-soluble film material used with preference is preferably between 15 and 120 μm, preferentially between 20 and 100 μm and, in particular, between 25 and 80 μm.

Instead of the water-soluble film web, it will be appreciated that it is also possible to apply plaques or prefabricated closure parts made of water-soluble material in step c) of the process according to the invention and also the preferred process variants described.

The thermoformed, water-soluble film material is filled in step b) of the process according to the invention. The filling can be effected with all static or mobile filling apparatus known to those skilled in the art for this purpose. To increase the throughput and in order to ensure exact filling of the receiving chambers, it is, however, preferred in the context of the present invention that the filling is effected by means of a mobile filling station which moves in transport direction of the receiving chambers during a filling operation and, after this filling operation has ended and before the start of the next filling operation, returns to its original position.

The filling from the group of the washing or cleaning compositions, cosmetics, pharmaceuticals, bodycare compositions, agrochemical assistants, adhesives, surface treatment compositions, building materials, dyes or foods can be introduced in liquid or solid form in the process according to the invention and its preferred variants. The liquids used may, in addition to liquid pure substances, also be solutions or dispersions. With particular preference, liquids are transferred whose viscosity changes after the filling owing to chemical or physical processes. Very particular preference is given to transferring liquids which solidify after filling owing to chemical or physical processes. The introduced solids may be present in any supply form known to those skilled in the art and useful for such purposes. Preference is given, in particular, to powder, granules, extrudates or compactates. It will be appreciated that liquids and solids may also be transferred into the receiving chamber simultaneously or offset in time. Particular preference is given to processes in which a solidifying liquid, preferably a melt is introduced into the receiving chamber in a first step, and a solid, preferably a powder, a granule or an extrudate, in a next step. It is preferred in this context to undertake the transfer of the solid only after the at least partial solidification of the liquid.

As is evident from the explanation above in the description, it is possible by the process according to the invention to produce not only compact vessels with one chamber but also vessels with two, three, four or more chambers. As is also evident from the remarks, it is unimportant whether these chambers are filled with solids or liquids for a successful process. This process technology freedom distinguishes the process according to the invention from the prior art processes. For illustration of possible embodiments of the one-chamber, two-chamber and three-chamber products produced by the process according to the invention, some particularly preferred embodiments are listed in the table which follows. The term "phase 1" refers to the first receiving chamber (bottom phase) formed in the process according to the invention or one of its preferred process variants.

| Phase 1 | Phase 2 | Phase 3 |
|---|---|---|
| Solid | — | — |
| Liquid | — | — |
| Solid 1 | Solid 2 | — |
| Solid | Liquid | — |
| Solid + Liquid 1* | Liquid 2 | — |
| Solid 1+ Liquid 1* | Solid 2 | — |
| Solid 1 | Solid 2 | Solid 3 |
| Solid 1 | Solid 2 | Liquid |
| Solid 1 | Liquid 1* | Liquid 2 |
| Solid 1 | Liquid 1* | Solid 2 |
| Liquid 1* | Solid | Liquid 2 |

*Preferably a solidified melt

After the filling and sealing, the filled receiving chambers are finished. In particularly preferred process variants, this finishing comprises, for example, the sealing of receiving chambers and/or the isolation of the receiving chambers.

For the sealing, preference is given to using a further packaging film, preferably a water-soluble or water-dispersible film. This further packaging film may be identical to the film used in step a), but may also differ from it, for example, in composition and/or thickness. In a preferred embodiment of the process according to the invention, the films used in step c) are a film which equates to the film from step c) in its composition but has a lower thickness in comparison. For the sealing, preference is given to using film webs. However, particular preference is given to a process variant in which the sealing film, even before the sealing, is present in the form of prefabricated labels whose size has been adjusted to the size of the depressions of the moldings and are taken from a supply and placed onto the depressions by means of a label applicator. The sealing is effected preferably by heat-sealing (for example, by means of heated molds or laser beam), by the action of solvent and/or adhesives or by compressive or squeezing forces. For the sealing, the receiving chamber in step c) can, however, also simply be covered with a further film without permanently bonding this film to the packaging film forming the receiving chamber.

Apart from by a further film material, the sealing in step c) of the process particularly preferred in accordance with the invention can also be effected, for example, by means of prefabricated pouches, i.e. filled and sealed portion pouches. Such portion pouches can be produced, for example, by thermoforming processes, injection-molding processes or blow-molding.

The packaged compositions produced in accordance with the invention can be isolated by all processes known to those skilled in the art. Preference is given to effecting the isolation by cutting or punching. Examples of suitable apparatus for the isolation by cutting are static or moving knives. Preference is given to using knives with a heated blade. Isolation by laser beams is a further preferred process variant.

The "isolation" of the filled receiving chambers can afford either individual filled and sealed chambers or supply units of two, three, four, five, six, seven, eight, nine, ten, eleven, twelve or more receiving chambers. In the case of supply units with two or more receiving chambers, these supply units are preferably provided with intended breakage sites for manual separation into individual chambers.

For the sealing and isolation, just like the filling, it is possible to use static or moving stations. The finishing stations are preferably also mobile and move in transport direction of the receiving chambers in order to return to their original position after the working step has ended.

The process according to the invention can be performed continuously or in batches. However, preference is given to a continuous process. However, a continuous process is preferred especially when the reshaping of the water-soluble material in step a) of the process according to the invention is effected by thermoforming of a water-soluble film material. Just like the vessels formed in step a), the introduced film material is transported continuously, preferably at a constant speed. The transport speed is preferably between 1 and 80 meters per minute, preferably between 10 and 60 meters per minute and, in particular, between 20 and 50 meters per minute. The transport is preferably effected horizontally.

The process according to the invention serves for the packaging of active substances or active substance mixtures from the group of the washing or cleaning compositions, cosmetics, pharmaceuticals, bodycare compositions, agrochemical assistants, adhesives, surface treatment compositions, building materials, dyes or foods. With particular preference, active substances from the group of the washing or cleaning compositions, especially laundry detergents, dishwasher detergents or surface detergents, are packaged by the process according to the invention. The group of laundry detergents includes, in particular, all-purpose laundry detergents, color laundry detergents, fine laundry detergents, textile softeners, textile care compositions or ironing assistants. The group of the dishwasher detergents includes the machine dishwasher detergents and machine rinse aids, and also manual dishwashing detergents. The surface detergents include descalers, compositions for the disinfection or sterilization of surfaces or objects and compositions for the cleaning of metal or glass surfaces. These compositions comprise preferably one or more further customary constituents of washing and cleaning compositions, preferably from the group of the builders, surfactants, polymers, bleaches, bleach activators, enzymes, dyes, fragrances, electrolytes, pH modifiers, perfume carriers, fluorescers, hydrotropes, foam inhibitors, silicone oils, antiredeposition agents, optical brighteners, graying inhibitors, shrink preventatives, crease preventatives, dye transfer inhibitors, active antimicrobial ingredients, germicides, fungicides, antioxidants, corrosion inhibitors, antistats, ironing assistants, repellency and impregnation agents, swelling and antislip agents and/or UV absorbers. These substances will be described more precisely below.

Builders

In the context of the present application, the builders include especially the zeolites, silicates, carbonates, organic cobuilders and, where there are no ecological objections to their use, also the phosphates.

Suitable crystalline, sheet-type sodium silicates have the general formula $NaMSi_xO_{2x+1} \neq H_2O$ where M is sodium or hydrogen, x is a number from 1.9 to 4, y is a number from 0 to 20, and preferred values for x are 2, 3 or 4. Preferred crystalline sheet silicates of the formula specified are those in which M is sodium and x assumes the values of 2 or 3. In particular, preference is given to both β- and also δ-sodium disilicates $Na_2Si_2O_5 \neq yH_2O$.

It is also possible to use amorphous sodium silicates having an $Na_2O:SiO_2$ modulus of from 1:2 to 1:3.3, preferably from 1:2 to 1:2.8 and, in particular, from 1:2 to 1:2.6, which have retarded dissolution and secondary washing properties. The retardation of dissolution relative to conventional amorphous sodium silicates may have been brought about in a variety of ways, for example, by surface treatment, compounding, compacting or by overdrying. In the context of this invention, the term "amorphous" also includes X-ray-amorphous This means that, in X-ray diffraction experiments, the silicates do not afford any sharp X-ray reflections typical of crystalline substances, but rather yield at best one or more maxima of the scattered X-radiation, which have a width of several degree units of the diffraction angle. However, it may quite possibly lead to even particularly good builder properties if the silicate particles in electron diffraction experiments yield vague or even sharp diffraction maxima. This is to be interpreted such that the products have microcrystalline regions with a size of from 10 to several hundred nm, preference being given to values up to a maximum of 50 nm and, in particular, up to a maximum of 20 nm. Such X-ray-amorphous silicates likewise have retarded dissolution compared with conventional waterglasses. Special preference is given to compacted amorphous silicates, compounded amorphous silicates and overdried X-ray-amorphous silicates.

In the context of the present invention, it is preferred that these silicate(s), preferably alkali metal silicates, more preferably crystalline or amorphous alkali metal disilicates, are present in washing or cleaning compositions in amounts of from 10 to 60% by weight, preferably from 15 to 50% by weight and, in particular, from 20 to 40% by weight, based in each case on the weight of the washing or cleaning composition.

When the silicates are used as a constituent of machine dishwasher detergents, these compositions preferably comprise at least one crystalline sheet-type silicate of the general formula $NaMSi_xO_{2x+1}.yH_2O$ where M is sodium or hydrogen, x is a number from 1.9 to 22, preferably from 1.9 to 4, and y is a number from 0 to 33. The crystalline sheet-type silicates of the formula $NaMSi_xO_{2x+1}.yH_2O$ are sold, for example, by Clariant GmbH (Germany) under the trade name Na—SKS, for example, Na—SKS-1 ($Na_2Si_{22}O_{45}.xH_2O$, kenyaite), Na—SKS-2 ($Na_2Si_{14}O_{29}.xH_2O$, magadiite), Na—SKS-3 ($Na_2Si_8O_{17}.xH_2O$) or Na—SKS-4 ($Na_2Si_4O_9.xH_2O$, makatite).

Particularly suitable for the purposes of the present invention are crystalline sheet silicates of the formula (I) in which x is 2. Among these, suitable, in particular, are Na—SKS-5 ($\alpha$-$Na_2Si_2O_5$), Na—SKS-7 ($\beta$-$Na_2Si_2O_5$, natrosilite), Na—SKS-9 ($NaHSi_2O_5.H_2O$), Na—SKS-10 ($NaHSi_2O_5.3H_2O$, kanemite), Na—SKS-11 (t-$Na_2Si_2O_5$) and Na—SKS-13 ($NaHSi_2O_5$), but, in particular, Na—SKS-6 ($\delta$-$Na_2Si_2O_5$).

When the silicates are used as a constituent of machine dishwasher detergents, these compositions in the context of the present application comprise a proportion by weight of the crystalline sheet-type silicate of the formula $NaMSi_xO_{2x+1}.yH_2O$ of from 0.1 to 20% by weight, preferably from 0.2 to 15% by weight and, in particular, from 0.4 to 10% by weight, based in each case on the total weight of these compositions. It is particularly preferred especially when such machine dishwasher detergents have a total silicate content below 7% by weight, preferably below 6% by weight, preferentially below 5% by weight, more preferably below 4% by weight, even more preferably below 3% by weight and, in particular, below 2.5% by weight, this silicate, based on the total weight of the silicate present, being silicate of the general formula $NaMSi_xO_{2x+1}.yH_2O$ preferably to an extent of at least 70% by weight, preferentially to an extent of at least 80% by weight and, in particular, to an extent of at least 90% by weight.

The finely crystalline, synthetic, bound water-containing zeolite used is preferably zeolite A and/or P. The zeolite P is more preferably Zeolite MAP® (commercial product from Crosfield). Also suitable, however, are zeolite X, and mixtures of A, X and/or P. Also commercially available and usable with preference in accordance with the present invention is, for example, a cocrystal of zeolite X and zeolite A (approximately 80% by weight of zeolite X), which is sold by CONDEA Augusta S.p.A. under the trade name VEGOBOND AX® and can be described by the formula $$n Na_2O.(1-n)K_2O.Al_2O_3.(2\text{-}2.5)SiO_2.(3.5\text{-}5.5)H_2O.$$

The zeolite may be used either as a builder in a granular compound or in a kind of "powdering" of the entire mixture to be compacted, and both ways of incorporating the zeolite into the premixture are typically utilized. Suitable zeolites have an average particle size of less than 10 μm (volume distribution; measurement method: Coulter Counter) and preferably contain from 18 to 22% by weight, in particular, from 20 to 22% by weight, of bound water.

It is of course also possible to use the commonly known phosphates as builder substances, as long as such a use is not to be avoided for ecological reasons. This is especially true for the use of inventive compositions as machine dishwasher detergents, which is particularly preferred in the context of the present application. Among the multitude of commercially available phosphates, the alkali metal phosphates, with particular preference for pentasodium triphosphate or pentapotassium triphosphate (sodium tripolyphosphate or potassium tripolyphosphate), have the greatest significance in the washing and cleaning products industry.

"Alkali metal phosphates" is the collective term for the alkali metal (especially sodium and potassium) salts of the various phosphoric acids, for which a distinction may be drawn between metaphosphoric acids $(HPO_3)_n$ and orthophosphoric acid $H_3PO_4$, in addition to higher molecular weight representatives. The phosphates combine a number of advantages: they act as alkali carriers, prevent limescale deposits on machine components and lime encrustations in fabrics, and additionally contribute to the cleaning performance.

Suitable phosphates are, for example, sodium dihydrogenphosphate, $NaH_2PO_4$, in the form of the dihydrate (density 1.91 $gcm^{-3}$, melting point 60°) or in the form of the monohydrate (density 2.04 $gcm^{-3}$), disodium hydrogen phosphate (secondary sodium phosphate), $Na_2HPO_4$, which is in anhydrous form or can be used with 2 mol of water (density 2.066 $gcm^{-3}$, loss of water at 95°), 7 mol of water (density 1.68 $gcm^{-3}$, melting point 48° with loss of $5H_2O$) and 12 mol of water (density 1.52 $gcm^{-3}$, melting point 35° with loss of 5 $H_2O$), but, in particular, trisodium phosphate (tertiary sodium phosphate) $Na_3PO_4$, which can be used as the dodecahydrate, as the decahydrate (corresponding to 19-20% $P_2O_5$) and in anhydrous form (corresponding to 39-40% $P_2O_5$).

A further preferred phosphate is tripotassium phosphate (tertiary or tribasic potassium phosphate), $K_3PO_4$. Preference is further given to tetrasodium diphosphate (sodium pyrophosphate), $Na_4P_2O_7$, which exists in anhydrous form (density 2.534 $gcm^{-3}$, melting point 988°, 880° also reported) and as the decahydrate (density 1.815-1.836 $gcm^{-3}$, melting point 94—with loss of water), and also the corresponding potassium salt, potassium diphosphate (potassium pyrophosphate), $K_4P_2O_7$.

Condensation of $NaH_2PO_4$ or of $KH_2PO_4$ gives rise to higher molecular weight sodium phosphates and potassium phosphates, for which a distinction can be drawn between cyclic representatives, the sodium metaphosphates and potassium metaphosphates, and catenated types, the sodium polyphosphates and potassium polyphosphates. For the latter, in particular, a multitude of names are in use: fused or calcined phosphates, Graham salt, Kurrol salt and Maddrell salt. All higher sodium and potassium phosphates are referred to collectively as condensed phosphates.

The industrially important pentasodium triphosphate, $Na_5P_3O_{10}$ (sodium tripolyphosphate), is a nonhygroscopic, white, water-soluble salt which is anhydrous or crystallizes with 6 $H_2O$ and has the general formula NaO—[P(O)(ONa)—O]$_n$—Na where n=3. The corresponding potassium salt, pentapotassium triphosphate, $K_5P_3O_{10}$ (potassium tripolyphosphate), is available commercially, for example, in the form of a 50% by weight solution (>23% $P_2O_5$, 25% $K_2O$). The potassium polyphosphates find wide use in the washing and cleaning products industry. There also exist sodium potassium tripolyphosphates which can likewise be used in the context of the present invention. They are formed, for example, when sodium trimetaphosphate is hydrolyzed with KOH:

$$(NaPO_3)_3+2KOH \rightarrow Na_3K_2P_3O_{10}+H_2O$$

They can be used in accordance with the invention in precisely the same way as sodium tripolyphosphate, potassium tripolyphosphate or mixtures of the two; mixtures of sodium tripolyphosphate and sodium potassium tripolyphosphate or mixtures of potassium tripolyphosphate and sodium potassium tripolyphosphate or mixtures of sodium tripolyphosphate and potassium tripolyphosphate and sodium potassium tripolyphosphate can also be used in accordance with the invention.

When phosphates are used as washing- or cleaning-active substances in washing or cleaning compositions in the context of the present application, preferred compositions comprise these phosphate(s), preferably alkali metal phosphate(s), more preferably pentasodium triphosphate or pentapotassium triphosphate (sodium tripolyphosphate or potassium tripolyphosphate), in amounts of from 5 to 80% by weight, preferably from 15 to 75% by weight and, in particular, from 20 to 70% by weight, based in each case on the weight of the washing or cleaning composition.

It is especially preferred to use potassium tripolyphosphate and sodium tripolyphosphate in a weight ratio of more than 1:1, preferably more than 2:1, preferentially more than 5:1, more preferably more than 10:1 and especially more than 20:1. It is particularly preferred to use exclusively potassium tripolyphosphate without additions of other phosphates.

Further builders are the alkali carriers. Alkali carriers include, for example, alkali metal hydroxides, alkali metal carbonates, alkali metal hydrogencarbonates, alkali metal sesquicarbonates, the aforementioned alkali metal silicates, alkali metal metasilicates and mixtures of the aforementioned substances, preference being given in the context of this invention to using the alkali metal carbonates, especially sodium carbonate, sodium hydrogencarbonate or sodium sesquicarbonate. Particular preference is given to a builder system comprising a mixture of tripolyphosphate and sodium carbonate. Particular preference is likewise given to a builder system comprising a mixture of tripolyphosphate and sodium carbonate and sodium disilicate. Owing to their low chemical compatibility with the remaining ingredients of washing or cleaning compositions in comparison with other builder substances, the alkali metal hydroxides are preferably used only in small amounts, preferably in amounts below 10% by weight, preferentially below 6% by weight, more preferably below 4% by weight and, in particular, below 2% by weight, based in each case on the total weight of the washing or cleaning composition. Particular preference is given to compositions which, based on their total weight, contain less than 0.5% by weight of and, in particular, no alkali metal hydroxides.

Particular preference is given to the use of carbonate(s) and/or hydrogencarbonate(s), preferably alkali metal carbonates, more preferably sodium carbonate, in amounts of from 2 to 50% by weight, preferably from 5 to 40% by weight and, in particular, from 7.5 to 30% by weight, based in each case on the weight of the washing or cleaning composition. Particular preference is given to compositions which, based on the weight of the washing or cleaning composition (i.e. the total weight of the combination product without packaging), contain less than 20% by weight, preferably less than 17% by weight, preferentially less than 13% by weight and, in particular, less than 9% by weight of carbonate(s) and/or hydrogencarbonate(s), preferably alkali metal carbonates, more preferably sodium carbonate.

Organic cobuilders include, in particular, polycarboxylates/polycarboxylic acids, polymeric polycarboxylates, aspartic acid, polyacetals, dextrins, further organic cobuilders (see below) and phosphonates. These substance classes are described below.

Organic builder substances which can be used are, for example, the polycarboxylic acids usable in the form of their sodium salts, polycarboxylic acids referring to those carboxylic acids which bear more than one acid function. Examples of these are citric acid, adipic acid, succinic acid, glutaric acid, malic acid, tartaric acid, maleic acid, fumaric acid, sugar acids, aminocarboxylic acids, nitrilotriacetic acid (NTA), as long as such a use is not objectionable on ecological grounds, and mixtures thereof. Preferred salts are the salts of the polycarboxylic acids such as citric acid, adipic acid, succinic acid, glutaric acid, tartaric acid, sugar acids and mixtures thereof.

The acids themselves may also be used. In addition to their builder action, the acids typically also have the property of an acidifying component and thus also serve to set a lower and milder pH of washing and cleaning compositions. In this connection, particular mention should be made of citric acid, succinic acid, glutaric acid, adipic acid, gluconic acid and any mixtures thereof.

Also suitable as builders are polymeric polycarboxylates; these are, for example, the alkali metal salts of polyacrylic acid or of polymethacrylic acid, for example, those having a relative molecular mass of from 500 to 70,000 g/mol.

In the context of this document, the molar masses specified for polymeric polycarboxylates are weight-average molar masses $M_w$ of the particular acid form, which has always been determined by means of gel-permeation chromatography (GPC) using a UV detector. The measurement was against an external polyacrylic acid standard which, owing to its structural similarity to the polymers under investigation, provides realistic molecular weight values. These figures deviate considerably from the molecular weight data when polystyrenesulfonic acids are used as the standard. The molar masses measured against polystyrenesulfonic acids are generally distinctly higher than the molar masses specified in this document.

Suitable polymers are, in particular, polyacrylates which preferably have a molecular mass of from 2,000 to 20,000 g/mol. Owing to their superior solubility, preference within this group may be given in turn to the short-chain polyacrylates which have molar masses of from 2,000 to 10,000 g/mol and more preferably from 3,000 to 5,000 g/mol.

Also suitable are copolymeric polycarboxylates, especially those of acrylic acid with methacrylic acid and of acrylic acid or methacrylic acid with maleic acid. Copolymers which have been found to be particularly suitable are those of acrylic acid with maleic acid which contain from 50 to 90% by weight of acrylic acid and from 50 to 10% by weight of maleic acid. Their relative molecular mass, based on free acids, is generally from 2,000 to 70,000 g/mol, preferably from 20,000 to 50,000 g/mol and, in particular, from 30,000 to 40,000 g/mol.

The (co)polymeric polycarboxylates can either be used in the form of powders or in the form of aqueous solutions. The (co)polymeric polycarboxylate content of the washing or cleaning compositions is preferably from 0.5 to 20% by weight, in particular, from 3 to 10% by weight.

To improve the water solubility, the polymers may also contain allylsulfonic acids, for example, allyloxybenzenesulfonic acid and methallylsulfonic acid, as monomers.

Also especially preferred are biodegradable polymers composed of more than two different monomer units, for example, those which contain, as monomers, salts of acrylic acid and of maleic acid, and vinyl alcohol or vinyl alcohol derivatives, or those which contain, as monomers, salts of acrylic acid and of 2-alkylallylsulfonic acid, and sugar derivatives.

Further preferred copolymers are those which preferably have, as monomers, acrolein and acrylic acid/acrylic acid salts or acrolein and vinyl acetate.

Further preferred builder substances which should likewise be mentioned are polymeric aminodicarboxylic acids, salts thereof or precursor substances thereof. Particular preference is given to polyaspartic acids or salts thereof.

Further suitable builder substances are polyacetals which can be obtained by reacting dialdehydes with polyolcarboxylic acids which have from 5 to 7 carbon atoms and at least 3 hydroxyl groups. Preferred polyacetals are obtained from dialdehydes such as glyoxal, glutaraldehyde, terephthalaldehyde, and mixtures thereof, and from polyolcarboxylic acids such as gluconic acid and/or glucoheptonic acid.

Further suitable organic builder substances are dextrins, for example, oligomers or polymers of carbohydrates, which can be obtained by partial hydrolysis of starches. The hydrolysis can be carried out by customary, for example, acid-catalyzed or enzyme-catalyzed, processes. The hydrolysis products preferably have average molar masses in the range from 400 to 500,000 g/mol. Preference is given to a polysaccharide having a dextrose equivalent (DE) in the range from 0.5 to 40, in particular, from 2 to 30, where DE is a common measure of the reducing action of a polysaccharide compared to dextrose, which has a DE of 100. It is also possible to use maltodextrins with a DE between 3 and 20 and dry glucose syrups with a DE between 20 and 37, and also what are known as yellow dextrins and white dextrins having relatively high molar masses in the range from 2,000 to 30,000 g/mol.

The oxidized derivatives of such dextrins are their reaction products with oxidizing agents which are capable of oxidizing at least one alcohol function of the saccharide ring to the carboxylic acid function.

Oxydisuccinates and other derivatives of disuccinates, preferably ethylenediaminedisuccinate, are also further suitable cobuilders. In this case, ethylenediamine-N,N'-disuccinate (EDDS) is preferably used in the form of its sodium or magnesium salts. Furthermore, in this connection, preference is also given to glyceryl disuccinates and glyceryl trisuccinates. Suitable use amounts in zeolite-containing and/or silicate-containing formulations are from 3 to 15% by weight.

Further organic cobuilders which can be used are, for example, acetylated hydroxycarboxylic acids or salts thereof, which may also be present in lactone form and which contain at least 4 carbon atoms and at least one hydroxyl group and a maximum of two acid groups.

A further class of substances having cobuilder properties is that of the phosphonates. These are, in particular, hydroxyalkane- and aminoalkanephosphonates. Among the hydroxyalkanephosphonates, 1-hydroxyethane-1,1-diphosphonate (HEDP) is of particular significance as a cobuilder. It is preferably used in the form of the sodium salt, the disodium salt giving a neutral reaction and the tetrasodium salt an alkaline reaction (pH 9). Useful aminoalkanephosphonates are preferably ethylenediamine-tetramethylenephos-phonate (EDTMP), diethylenetriaminepentamethylene-phosphonate (DTPMP) and higher homologs thereof. They are preferably used in the form of the neutrally reacting sodium salts, for example, as the hexasodium salt of EDTMP or as the hepta- and octasodium salt of DTPMP. From the class of the phosphonates, preference is given to using HEDP as a builder. In addition, the aminoalkanephosphonates have a marked heavy metal-binding capacity. Accordingly, especially when the compositions also comprise bleaches, it may be preferable to use aminoalkanephosphonates, especially DTPMP, or mixtures of the phosphonates mentioned.

In addition, it is possible to use all compounds which are capable of forming complexes with alkaline earth metal ions as builders.

Surfactants

The group of the surfactants includes not only the nonionic surfactants but also the anionic, cationic and amphoteric surfactants.

The nonionic surfactants used are preferably alkoxylated, advantageously ethoxylated, in particular, primary alcohols having preferably from 8 to 18 carbon atoms and on average from 1 to 12 mol of ethylene oxide (EO) per mole of alcohol in which the alcohol radical may be linear or preferably 2-methyl-branched, or may contain a mixture of linear and methyl-branched radicals, as are typically present in oxo alcohol radicals. However, especially preferred alcohol ethoxylates have linear radicals of alcohols of natural origin having from 12 to 18 carbon atoms, for example, of coconut, palm, tallow fat or oleyl alcohol, and on average from 2 to 8 EO per mole of alcohol. The preferred ethoxylated alcohols include, for example, $C_{12-14}$-alcohols having 3 EO or 4 EO, $C_{9-11}$-alcohol having 7 EO, $C_{13-15}$-alcohols having 3 EO, 5 EO, 7 EO or 8 EO, $C_{12-18}$-alcohols having 3 EO, 5 EO or 7 EO and mixtures thereof, such as mixtures of $C_{12-14}$-alcohol having 3 EO and $C_{12-18}$-alcohol having 5 EO. The degrees of ethoxylation specified are statistical average values which may be an integer or a fraction for a specific product. Preferred alcohol ethoxylates have a narrowed homolog distribution (narrow range ethoxylates, NRE). In addition to these nonionic surfactants, it is also possible to use fatty alcohols having more than 12 EO. Examples thereof are tallow fatty alcohol having 14 EO, 25 EO, 30 EO or 40 EO.

In addition, further nonionic surfactants which may be used are also alkyl glycosides of the general formula $RO(G)_x$ in which R is a primary straight-chain or methyl-branched, in particular, 2-methyl-branched, aliphatic radical having from 8 to 22, preferably from 12 to 18, carbon atoms and G is the symbol which is a glycose unit having 5 or 6 carbon atoms, preferably glucose. The degree of oligomerization x, which specifies the distribution of monoglycosides and oligoglycosides, is any number between 1 and 10; x is preferably from 1.2 to 1.4.

A further class of nonionic surfactants used with preference, which are used either as the sole nonionic surfactant or in combination with other nonionic surfactants, are alkoxylated, preferably ethoxylated or ethoxylated and propoxylated, fatty acid alkyl esters, preferably having from 1 to 4 carbon atoms in the alkyl chain.

Nonionic surfactants of the amine oxide type, for example, N-cocoalkyl-N,N-dimethylamine oxide and N-tallowalkyl-N,N-dihydroxyethylamine oxide, and of the fatty acid alkanolamide type may also be suitable. The amount of these nonionic surfactants is preferably not more than that of the ethoxylated fatty alcohols, in particular, not more than half thereof.

Further suitable surfactants are polyhydroxy fatty acid amides of the formula (I)

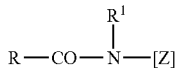

(I)

in which RCO is an aliphatic acyl radical having from 6 to 22 carbon atoms, $R^1$ is hydrogen, an alkyl or hydroxyalkyl radical having from 1 to 4 carbon atoms and [Z] is a linear or branched polyhydroxyalkyl radical having from 3 to 10 carbon atoms and from 3 to 10 hydroxyl groups. The polyhydroxy fatty acid amides are known substances which can typically be obtained by reductively aminating a reducing sugar with ammonia, an alkylamine or an alkanolamine, and subsequently acylating with a fatty acid, a fatty acid alkyl ester or a fatty acid chloride.

The group of polyhydroxy fatty acid amides also includes compounds of the formula

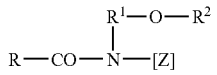

in which R is a linear or branched alkyl or alkenyl radical having from 7 to 12 carbon atoms, $R^1$ is a linear, branched or cyclic alkyl radical or an aryl radical having from 2 to 8 carbon atoms and $R^2$ is a linear, branched or cyclic alkyl radical or an aryl radical or an oxyalkyl radical having from 1 to 8 carbon atoms, preference being given to $C_{1-4}$-alkyl or phenyl radicals, and [Z] is a linear polyhydroxyalkyl radical whose alkyl chain is substituted by at least two hydroxyl groups, or alkoxylated, preferably ethoxylated or propoxylated, derivatives of this radical.

[Z] is preferably obtained by reductive amination of a reduced sugar, for example, glucose, fructose, maltose, lactose, galactose, mannose or xylose. The N-alkoxy- or N-aryloxy-substituted compounds can be converted to the desired polyhydroxy fatty acid amides by reaction with fatty acid methyl esters in the presence of an alkoxide as catalyst.

The surfactants used with preference are low-foaming nonionic surfactants. With particular preference, cleaning compositions for machine dishwashing comprise nonionic surfactants, in particular, nonionic surfactants from the group of the alkoxylated alcohols. The nonionic surfactants used are preferably alkoxylated, advantageously ethoxylated, in particular, primary alcohols having preferably from 8 to 18 carbon atoms and on average from 1 to 12 mol of ethylene oxide (EO) per mole of alcohol in which the alcohol radical may be linear or preferably 2-methyl-branched, or may contain a mixture of linear and methyl-branched radicals, as are typically present in oxo alcohol radicals. However, especially preferred are alcohol ethoxylates having linear radicals of alcohols of natural origin having from 12 to 18 carbon atoms, for example, of coconut, palm, tallow fat or oleyl alcohol, and on average from 2 to 8 EO per mole of alcohol. The preferred ethoxylated alcohols include, for example, $C_{12-14}$-alcohols having 3 EO or 4 EO, $C_{9-11}$-alcohol having 7 EO, $C_{13-15}$-alcohols having 3 EO, 5 EO, 7 EO or 8 EO, $C_{12-18}$-alcohols having 3 EO, 5 EO or 7 EO and mixtures thereof, such as mixtures of $C_{12-14}$-alcohol having 3 EO and $C_{12-18}$-alcohol having 5 EO. The degrees of ethoxylation specified are statistical average values which may be an integer or a fraction for a specific product. Preferred alcohol ethoxylates have a narrowed homolog distribution (narrow range ethoxylates, NRE). In addition to these nonionic surfactants, it is also possible to use fatty alcohols having more than 12 EO. Examples thereof are tallow fatty alcohol having 14 EO, 25 EO, 30 EO or 40 EO.

Special preference is given to nonionic surfactants which have a melting point above room temperature, particular preference being given to nonionic surfactants having a melting point above 20° C., preferably above 25° C., more preferably between 25 and 60° C. and, in particular, between 26.6 and 43.3° C.

Suitable nonionic surfactants which have melting or softening points in the temperature range specified are, for example, low-foaming nonionic surfactants which may be solid or highly viscous at room temperature. When nonionic surfactants which have a high viscosity at room temperature are used, they preferably have a viscosity above 20 Pas, preferably above 35 Pas and, in particular, above 40 Pas. Nonionic surfactants which have a waxlike consistency at room temperature are also preferred.

Nonionic surfactants which are solid at room temperature and are to be used with preference stem from the groups of alkoxylated nonionic surfactants, in particular, the ethoxylated primary alcohols and mixtures of these surfactants with structurally complex surfactants, such as polyoxypropylene/polyoxyethylene/polyoxypropylene (PO/EO/PO) surfactants. Such (PO/EO/PO) nonionic surfactants are additionally notable for good foam control.

In a preferred embodiment of the present invention, the nonionic surfactant with a melting point above room temperature is an ethoxylated nonionic surfactant which has resulted from the reaction of a monohydroxyalkanol or alkylphenol having from 6 to 20 carbon atoms with preferably at least 12 mol, more preferably at least 15 mol, in particular, at least 20 mol, of ethylene oxide per mole of alcohol or alkylphenol.

A nonionic surfactant which is solid at room temperature and is to be used with particular preference is obtained from a straight-chain fatty alcohol having from 16 to 20 carbon atoms ($C_{16-20}$-alcohol), preferably a $C_{18}$-alcohol, and at least 12 mol, preferably at least 15 mol and, in particular, at least 20 mol, of ethylene oxide. Of these, the "narrow range ethoxylates" (see above) are particularly preferred.

Accordingly, particular preference is given to ethoxylated nonionic surfactants which have been obtained from $C_{6-20}$-monohydroxyalkanols or $C_{6-20}$-alkylphenols or $C_{16-20}$-fatty alcohols and more than 12 mol, preferably more than 15 mol and, in particular, more than 20 mol of ethylene oxide per mole of alcohol.

The room temperature solid nonionic surfactant preferably additionally has propylene oxide units in the molecule. Preferably, such PO units make up up to 25% by weight, more preferably up to 20% by weight and, in particular, up to 15% by weight, of the total molar mass of the nonionic surfactant. Particularly preferred nonionic surfactants are ethoxylated monohydroxyalkanols or alkylphenols which additionally have polyoxyethylene-polyoxypropylene block copolymer units. The alcohol or alkylphenol moiety of such nonionic surfactant molecules preferably makes up more than 30% by weight, more preferably more than 50% by weight and, in particular, more than 70% by weight, of the total molar mass of such nonionic surfactants. Preferred dishwasher detergents are characterized in that they comprise ethoxylated and propoxylated nonionic surfactants in which the propylene oxide units in the molecule make up up to 25% by weight, preferably up to 20% by weight and, in particular, up to 15% by weight, of the total molar mass of the nonionic surfactant.

Further nonionic surfactants which have melting points above room temperature and are to be used with particular preference contain from 40 to 70% of a polyoxypropylene/polyoxyethylene/polyoxypropylene block polymer blend which contains 75% by weight of an inverse block copolymer of polyoxyethylene and polyoxypropylene having 17 mol of ethylene oxide and 44 mol of propylene oxide, and 25% by weight of a block copolymer of polyoxyethylene and polyoxypropylene initiated with trimethylolpropane and containing 24 mol of ethylene oxide and 99 mol of propylene oxide per mole of trimethylolpropane.

Nonionic surfactants which can be used with particular preference are obtainable, for example, under the name Poly Tergent® SLF-18 from Olin Chemicals.

In washing or cleaning compositions, preferably in dishwasher detergents, use is made of the nonionic surfactant of the formula (II)

$$R^1O[CH_2CH(CH_3)O]_x[CH_2CH_2O]_y[CH_2CH(OH)R^2] \quad (II)$$

In which $R^1$ is a linear or branched aliphatic hydrocarbon radical having from 4 to 18 carbon atoms or mixtures thereof, $R^2$ is a linear or branched hydrocarbon radical having from 2 to 26 carbon atoms or mixtures thereof, and x is a value between 0.5 and 1.5, and y is a value of at least 15.

Further nonionic surfactants which can be used with preference are the terminally capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having from 1 to 30 carbon atoms, $R^3$ is H or a methyl, ethyl, n-propyl, isopropyl, n-butyl, 2-butyl or 2-methyl-2-butyl radical, x is a value between 1 and 30, k and j are values between 1 and 12, preferably between 1 and 5. When the value x is ≧2, each $R^3$ in the above formula may be different. $R^1$ and $R^2$ are preferably linear or branched, saturated or unsaturated, aliphatic or aromatic hydrocarbon radicals having from 6 to 22 carbon atoms, particular preference being given to radicals having from 8 to 18 carbon atoms. For the $R^3$ radical, particular preference is given to H, —$CH_3$ or —$CH_2CH_3$. Particularly preferred values for x are in the range from 1 to 20, in particular, from 6 to 15.

As described above, each $R^3$ in the above formula may be different if x is ≧2. This allows the alkylene oxide unit in the square brackets to be varied. When x is, for example, 3, the $R^3$ radical may be selected so as to form ethylene oxide ($R^3$=H) or propylene oxide ($R^3$=$CH_3$) units which can be joined together in any sequence, for example, (EO)(PO)(EO), (EO)(EO)(PO), (EO)(EO)(EO), (PO)(EO)(PO), (PO)(PO)(EO) and (PO)(PO)(PO). The value 3 for x has been selected here by way of example and it is entirely possible for it to be larger, the scope of variation increasing with increasing x values and embracing, for example, a large number of (EO) groups combined with a small number of (PO) groups, or vice versa.

Especially preferred terminally capped poly(oxyalkylated) alcohols of the above formula have values of k=1 and j=1, so that the above formula is simplified to $$R^1O[CH_2CH(R^3)O]_xCH_2CH(OH)CH_2OR^2.$$

In the latter formula, $R^1$, $R^2$ and $R^3$ are each as defined above and x is a number from 1 to 30, preferably from 1 to 20 and, in particular, from 6 to 18. Particular preference is given to surfactants in which the $R^1$ and $R^2$ radicals have from 9 to 14 carbon atoms, $R^3$ is H and x assumes values of from 6 to 15.

If the latter statements are summarized, preference is given to the terminally capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having from 1 to 30 carbon atoms, $R^3$ is H or a methyl, ethyl, n-propyl, isopropyl, n-butyl, 2-butyl or 2-methyl-2-butyl radical, x is a value between 1 and 30, k and j are values between 1 and 12, preferably between 1 and 5, particular preference being given to surfactants of the $$R^1O[CH_2CH(R^3)O]_xCH_2CH(OH)CH_2OR^2$$

type in which x is a number from 1 to 30, preferably from 1 to 20 and, in particular, from 6 to 18.

Particularly preferred nonionic surfactants in the context of the present invention have been found to be low-foaming nonionic surfactants which have alternating ethylene oxide and alkylene oxide units. Among these, preference is given in turn to surfactants having EO-AO-EO-AO blocks, and in each case from one to ten EO and/or AO groups are bonded to one another before a block of the other groups in each case follows. Preference is given here to inventive machine dishwasher detergents which comprise, as nonionic surfactant(s), surfactants of the general formula III $$R^1-O-(CH_2-CH_2-O)_w-(CH_2-\underset{\underset{R^2}{|}}{CH}-O)_x-(CH_2-CH_2-O)_y-(CH_2-\underset{\underset{R^3}{|}}{CH}-O)_2-H \quad (III)$$

in which $R^1$ is a straight-chain or branched, saturated or mono- or polyunsaturated $C_{6-24}$-alkyl or -alkenyl radical; each $R^2$ or $R^3$ group is independently selected from —$CH_3$; —$CH_2CH_3$, —$CH_2CH_2$—$CH_3$, $CH(CH_3)_2$ and the indices w, x, y, z are each independently integers from 1 to 6.

The preferred nonionic surfactants of the formula III can be prepared by known methods from the corresponding alcohols $R^1$—OH and ethylene oxide or alkylene oxide. The $R^1$ radical in the above formula III may vary depending on the origin of the alcohol. When native sources are utilized, the $R^1$ radical has an even number of carbon atoms and is generally unbranched, and preference is given to the linear radicals of alcohols of native origin having from 12 to 18 carbon atoms, for example, from coconut, palm, tallow fat or oleyl alcohol. Alcohols obtainable from synthetic sources are, for example, the Guerbet alcohols or 2-methyl-branched or linear and methyl-branched radicals in a mixture, as are typically present in oxo alcohol radicals. Irrespective of the type of the alcohol used to prepare the nonionic surfactants present in accordance with the invention in the compositions, preference is given to inventive machine dishwasher detergents in which $R^1$ in formula III is an alkyl radical having from 6 to 24, preferably from 8 to 20, more preferably from 9 to 15 and, in particular, from 9 to 11 carbon atoms.

The alkylene oxide unit which is present in the preferred nonionic surfactants in alternation to the ethylene oxide unit is, as well as propylene oxide, especially butylene oxide. However, further alkylene oxides in which $R^2$ and $R^3$ are each independently selected from —$CH_2CH_2$—$CH_3$ and $CH(CH_3)_2$ are also suitable. Preferred machine dishwasher detergents are characterized in that $R^2$ and $R^3$ are each a —$CH_3$ radical, w and x are each independently 3 or 4, and y and z are each independently 1 or 2.

In summary, preference is given in particular, to nonionic surfactants which have a $C_{9-15}$-alkyl radical having from 1 to 4 ethylene oxide units, followed by from 1 to 4 propylene oxide units, followed by from 1 to 4 ethylene oxide units, followed by from 1 to 4 propylene oxide units. In aqueous solution, these surfactants have the required low viscosity and can be used with particular preference in accordance with the invention.

Further nonionic surfactants usable with preference are the terminally capped poly(oxyalkylated)nonionic surfactants of the formula (IV)

$$R^1O[CH_2CH(R^3)O]_xR^2 \quad (IV)$$

in which $R^1$ is linear or branched, saturated or unsaturated, aliphatic or aromatic hydrocarbon radicals having from 1 to 30 carbon atoms, $R^2$ is linear or branched, saturated or unsaturated, aliphatic or aromatic hydrocarbon radicals having from 1 to 30 carbon atoms and preferably having between 1 and 5 hydroxyl groups and are preferably further functionalized with an ether group, $R^3$ is H or a methyl, ethyl, n-propyl, isopropyl, n-butyl, 2-butyl or 2-methyl-2-butyl radical, x is values between 1 and 40.

In particularly preferred nonionic surfactants of the above formula (IV), $R^3$ is H. In the resulting terminally capped poly(oxyalkylated) nonionic surfactants of the formula (V)

$$R^1O[CH_2CH_2O]_xR^2 \quad (V),$$

preference is given, in particular, to those nonionic surfactants in which $R^1$ is linear or branched, saturated or unsaturated, aliphatic or aromatic hydrocarbon radicals having from 1 to 30 carbon atoms, preferably having from 4 to 20 carbon atoms, $R^2$ is linear or branched, saturated or unsaturated, aliphatic or aromatic hydrocarbon radicals having from 1 to 30 carbon atoms and which preferably have between 1 and 5 hydroxyl groups, and x is values between 1 and 40.

Preference is given, in particular, to those terminally capped poly(oxyalkylated) nonionic surfactants which, according to the formula (VI)

$$R^1O[CH_2CH_2O]_xCH_2CH(OH)R^2 \quad (VI),$$

have not only an $R^1$ radical which is linear or branched, saturated or unsaturated, aliphatic or aromatic hydrocarbon radicals having from 1 to 30 carbon atoms, preferably having from 4 to 20 carbon atoms, but also a linear or branched, saturated or unsaturated, aliphatic or aromatic hydrocarbon radical having from 1 to 30 carbon atoms $R^2$ which is adjacent to a monohydroxylated intermediate group —$CH_2CH(OH)$—. In this formula, x is values between 1 and 40. Such terminally capped poly(oxyalkylated) nonionic surfactants can be obtained, for example, by reacting a terminal epoxide of the formula $R^2CH(O)CH_2$ with an ethoxylated alcohol of the formula $R^1O[CH_2CH_2O]_{x-1}CH_2CH_2OH$.

The specified carbon chain lengths and degrees of ethoxylation or degrees of alkoxylation of the aforementioned nonionic surfactants constitute statistical averages which may be a whole number or a fraction for a specific product. As a consequence of the preparation process, commercial products of the formulas specified do not usually consist of one individual representative, but rather of mixtures, as a result of which average values and consequently fractions can arise both for the carbon chain lengths and for the degrees of ethoxylation or degrees of alkoxylation.

The anionic surfactants used are, for example, those of the sulfonate and sulfate type. Useful surfactants of the sulfonate type are preferably $C_{9-13}$-alkylbenzenesulfonates, olefinsulfonates, i.e. mixtures of alkene- and hydroxyalkanesulfonates, and disulfonates, as are obtained, for example, from $C_{12-18}$-monoolefins with terminal or internal double bond by sulfonation with gaseous sulfur trioxide and subsequent alkaline or acidic hydrolysis of the sulfonation products. Also suitable are alkanesulfonates which are obtained from $C_{12-18}$-alkanes, for example, by sulfochlorination or sulfoxidation with subsequent hydrolysis or neutralization. The esters of α-sulfo fatty acids (ester sulfonates), for example, the α-sulfonated methyl esters of hydrogenated coconut, palm kernel or tallow fatty acids, are also likewise suitable.

Further suitable anionic surfactants are sulfated fatty acid glycerol esters. Fatty acid glycerol esters refer to the mono-, di- and triesters, and mixtures thereof, as are obtained in the preparation by esterification of a monoglycerol with from 1 to 3 mol of fatty acid or in the transesterification of triglycerides with from 0.3 to 2 mol of glycerol. Preferred sulfated fatty acid glycerol esters are the sulfation products of saturated fatty acids having from 6 to 22 carbon atoms, for example, of caproic acid, caprylic acid, capric acid, myristic acid, lauric acid, palmitic acid, stearic acid or behenic acid.

Preferred alk(en)yl sulfates are the alkali metal and, in particular, the sodium salts of the sulfuric monoesters of $C_{12}$-$C_{18}$ fatty alcohols, for example, of coconut fatty alcohol, tallow fatty alcohol, lauryl, myristyl, cetyl or stearyl alcohol, or of $C_{10}$-$C_{20}$ oxo alcohols and those monoesters of secondary alcohols of these chain lengths. Also preferred are alk(en)yl sulfates of the chain length mentioned which contain a synthetic straight-chain alkyl radical prepared on a petrochemical basis and which have analogous degradation behavior to the equivalent compounds based on fatty chemical raw materials. From the washing point of view, preference is given to the $C_{12}$-$C_{16}$-alkyl sulfates and $C_{12}$-$C_{15}$-alkyl sulfates, and $C_{14}$-$C_{15}$-alkyl sulfates. 2,3-Alkyl sulfates, which can be obtained as commercial products from the Shell Oil Company under the name DAN®, are also suitable anionic surfactants.

Also suitable are the sulfuric monoesters of the straight-chain or branched $C_{7-21}$-alcohols ethoxylated with 1 to 6 mol of ethylene oxide, such as 2-methyl-branched $C_{9-11}$-alcohols with on average 3.5 mol of ethylene oxide (EO) or $C_{12-18}$-fatty alcohols with from 1 to 4 EO. Owing to their high tendency to foam, they are used in cleaning compositions only in relatively small amounts, for example, amounts of from 1 to 5% by weight.

Further suitable anionic surfactants are also the salts of alkylsulfosuccinic acid, which are also referred to as sulfosuccinates or as sulfosuccinic esters and are the monoesters and/or diesters of sulfosuccinic acid with alcohols, preferably fatty alcohols and, in particular, ethoxylated fatty alcohols. Preferred sulfosuccinates contain $C_{8-18}$ fatty alcohol radicals or mixtures thereof. Especially preferred sulfosuccinates contain a fatty alcohol radical which is derived from ethoxylated fatty alcohols which, considered alone, constitute nonionic surfactants (for description, see below). In this context, particular preference is again given to sulfosuccinates whose fatty alcohol radicals are derived from ethoxylated fatty alcohols with a narrowed homolog distribution. It is also equally possible to use alk(en)ylsuccinic acid having preferably from 8 to 18 carbon atoms in the alk(en)yl chain or salts thereof.

Useful further anionic surfactants are in particular, soaps. Suitable soaps are saturated fatty acid soaps, such as the salts of lauric acid, myristic acid, palmitic acid, stearic acid, hydrogenated erucic acid and behenic acid, and soap mixtures derived, in particular, from natural fatty acids, for example, coconut, palm kernel or tallow fatty acids.

The anionic surfactants including the soaps may be present in the form of their sodium, potassium or ammonium salts, and also in the form of soluble salts of organic bases, such as mono-, di- or triethanolamine. The anionic surfactants are preferably present in the form of their sodium or potassium salts, in particular, in the form of the sodium salts.

When the anionic surfactants are a constituent of machine dishwasher detergents, their content, based on the total weight of the compositions, is preferably less than 4% by weight, preferentially less than 2% by weight and most preferably less than 1% by weight. Special preference is given to machine dishwasher detergents which do not contain any anionic surfactants.

Instead of the surfactants mentioned or in conjunction with them, it is also possible to use cationic and/or amphoteric surfactants.

The cationic active substances used may, for example, be cationic compounds of the formulas VII, VIII or IX:

(IV)

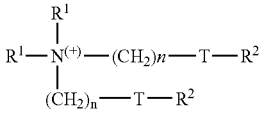

(V)

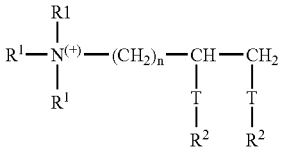

(VI)

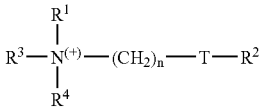

(VII)

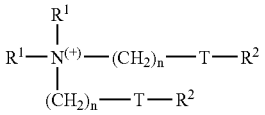

(VIII)

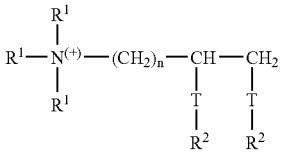

(IX)

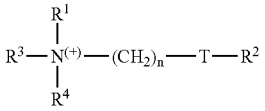

in which each $R^1$ group is independently selected from $C_{1-6}$-alkyl, -alkenyl or -hydroxyalkyl groups; each $R^2$ group is independently selected from $C_{8-28}$-alkyl or -alkenyl groups; $R^3=R^1$ or $(CH_2)_n$-T-$R^2$; $R^4=R^1$ or $R^2$ or $(CH_2)_n$-T-$R^2$; T=—$CH_2$—, —O—CO— or —CO—O— and n is an integer from 0 to 5.

In machine dishwasher detergents, the content of cationic and/or amphoteric surfactants is preferably less than 6% by weight, preferentially less than 4% by weight, even more preferably less than 2% by weight and, in particular, less than 1% by weight. Particular preference is given to machine dishwasher detergents which do not contain any cationic or amphoteric surfactants.

Polymers

The group of polymers includes, in particular, the washing- or cleaning-active polymers, for example, the rinse aid polymers and/or polymers active as softeners. Generally, not only nonionic polymers but also cationic, anionic and amphoteric polymers can be used in washing and cleaning compositions.

Polymers effective as softeners are, for example, the polymers containing sulfonic acid groups, which are used with particular preference.

Polymers which contain sulfonic acid groups and can be used with particular preference are copolymers of unsaturated carboxylic acids, monomers containing sulfonic acid groups and optionally further ionic or nonionogenic monomers.

In the context of the present invention, preference is given to unsaturated carboxylic acids of the formula X as a monomer $$R^1(R^2)C{=}C(R^3)COOH \quad (X)$$

in which $R^1$ to $R^3$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals as defined above and substituted by —$NH_2$, —OH or —COOH, or are —COOH or —$COOR^4$ where $R^4$ is a saturated or unsaturated, straight-chain or branched hydrocarbon radical having from 1 to 12 carbon atoms.

Among the unsaturated carboxylic acids which can be described by the formula X, preference is given, in particular, to acrylic acid ($R^1=R^2=R^3=H$), methacrylic acid ($R^1=R^2=H$; $R^3=CH_3$) and/or maleic acid ($R^1=COOH$; $R^2=R^3=H$).

The monomers containing sulfonic acid groups are preferably those of the formula XI $$R^5(R^6)C{=}C(R^7)—X—SO_3H \quad (XI)$$

in which $R^5$ to $R^7$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals as defined above and substituted by —$NH_2$, —OH or —COOH, or are —COOH or —$COOR^4$ where $R^4$ is a saturated or unsaturated, straight-chain or branched hydrocarbon radical having from 1 to 12 carbon atoms, and X is an optionally present spacer group which is selected from —$(CH_2)_n$— where n=from 0 to 4, —COO—$(CH_2)_k$— where k=from 1 to 6, —C(O)—NH—$C(CH_3)_2$— and —C(O)—NH—$CH(CH_2CH_3)$—.

Among these monomers, preference is given to those of the formulas XIa, XIb and/or XIc:

$$H_2C{=}CH—X—SO_3H \quad (XIa)$$

$$H_2C{=}C(CH_3)—X—SO_3H \quad (XIb)$$

$$HO_3S—X—(R^6)C{=}C(R^7)—X—SO_3H \quad (XIc)$$

in which $R^6$ and $R^7$ are each independently selected from —H, —$CH_3$, —$CH_2CH_3$, —$CH_2CH_2CH_3$, —$CH(CH_3)_2$ and X is an optionally present spacer group which is selected from —$(CH_2)$— where n=from 0 to 4, —COO—$(CH_2)_k$— where k=from 1 to 6, —C(O)—NH—$C(CH_3)_2$— and —C(O)—NH—$CH(CH_2CH_3)$—.

Particularly preferred monomers containing sulfonic acid groups are 1-acrylamido-1-propanesulfonic acid (X=—C(O)NH—$CH(CH_2CH_3)$ in formula XIa), 2-acrylamido-2-propanesulfonic acid (X=—C(O)NH—$C(CH_3)_2$ in formula XIa), 2-acrylamido-2-methyl-1-propanesulfonic acid (X=—C(O)NH$CH(CH_3)CH_2$— in formula XIa), 2-methacrylamido-2-methyl-1-propanesulfonic acid (X=—C(O)NH—$CH(CH_3)CH_2$— in formula XIb), 3-methacrylamido-2-hydroxypropanesulfonic acid (X=—C(O)NH—$CH_2$CH(OH)$CH_2$— in formula XIb), allylsulfonic acid (X=$CH_2$ in formula XIIa), methallylsulfonic acid (X=$CH_2$ in formula XIb), allyloxybenzenesulfonic acid (X=—$CH_2$—O—$C_6H_4$— in formula XIa), methallyloxybenzenesulfonic acid (X=—$CH_2$—O—$C_6H_4$— in formula XIb), 2-hydroxy-3-(2-propenyloxy)propanesulfonic acid, 2-methyl-2-propene-1-sulfonic acid (X=$CH_2$ in formula XIb), styrenesulfonic acid (X=$C_6H_4$ in formula XIa), vinylsulfonic acid (X not present in formula XIa), 3-sulfopropyl acrylate (X=—C(O)NH—$CH_2CH_2CH_2$— in formula XIa), 3-sulfopropyl methacrylate (X=—C(O)NH—$CH_2CH_2CH_2$— in formula XIb), sulfomethacrylamide (X=—C(O)NH— in formula XIb), sulfomethylmethacrylamide (X=—C(O)NH—$CH_2$— in formula XIb) and water-soluble salts of the acids mentioned.

Useful further ionic or nonionogenic monomers are, in particular, ethylenically unsaturated compounds. The content of monomers of group iii) in the polymers used in accordance with the invention is preferably less than 20% by weight, based on the polymer. Polymers to be used with particular preference consist only of monomers of groups i) and ii).

In summary, particular preference is given to copolymers of i) unsaturated carboxylic acids of the formula X $$R^1(R^2)C{=}C(R^3)COOH \quad (X)$$

in which $R^1$ to $R^3$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals as defined above and substituted by —$NH_2$, —OH or —COOH, or are —COOH or —$COOR^4$ where $R^4$ is a saturated or unsaturated, straight-chain or branched hydrocarbon radical having from 1 to 12 carbon atoms, ii) monomers of the formula XI containing sulfonic acid groups $$R^5(R^6)C{=}C(R^7)—X—SO_3H \quad (XI)$$

in which $R^5$ to $R^7$ are each independently —H, —$CH_3$, a straight-chain or branched saturated alkyl radical having from 2 to 12 carbon atoms, a straight-chain or branched, mono- or polyunsaturated alkenyl radical having from 2 to 12 carbon atoms, alkyl or alkenyl radicals as defined above and substituted by —$NH_2$, —OH or —COOH, or are —COOH or —$COOR^4$ where $R^4$ is a saturated or unsaturated, straight-chain or branched hydrocarbon radical having from 1 to 12 carbon atoms, and X is an optionally present spacer group which is selected from —($CH_2$)— where n=from 0 to 4, —COO—$(CH_2)_k$— where k=from 1 to 6, —C(O)—NH—C$(CH_3)_2$— and —C(O)—NH—CH($CH_2CH_3$)— iii) optionally further ionic or nonionogenic monomers.

Further particularly preferred copolymers consist of i) one or more unsaturated carboxylic acids from the group of acrylic acid, methacrylic acid and/or maleic acid, ii) one or more monomers containing sulfonic acid groups of the formulas XIa, XIb and/or XIc:

$$H_2C{=}CH—X—SO_3H \quad (XIa)$$

$$H_2C{=}C(CH_3)—X—SO_3H \quad (XIb)$$

$$HO_3S—X—(R^6)C{=}C(R^7)—X—SO_3H \quad (XIc)$$

in which $R^6$ and $R^7$ are each independently selected from —H, —$CH_3$, —$CH_2CH_3$, —$CH_2CH_2CH_3$, —$CH(CH_3)_2$ and X is an optionally present spacer group which is selected from —($CH_2$)— where n=from 0 to 4, —COO—$(CH_2)_k$— where k=from 1 to 6, —C(O)—NH—C$(CH_3)_2$— and —C(O)—NH—CH($CH_2CH_3$)— iii) optionally further ionic or nonionogenic monomers.

The copolymers may contain the monomers from groups i) and ii) and optionally iii) in varying amounts, and it is possible to combine any of the representatives from group i) with any of the representatives from group ii) and any of the representatives from group iii). Particularly preferred polymers have certain structural units which are described below.

Thus, preference is given, for example, to copolymers which contain structural units of the formula XII $$—[CH_2—CHCOOH]_m—[CH_2—CHC(O)—Y—SO_3H]_p— \quad (XII)$$

in which m and p are each a whole natural number between 1 and 2,000, and Y is a spacer group which is selected from substituted or unsubstituted, aliphatic, aromatic or araliphatic hydrocarbon radicals having from 1 to 24 carbon atoms, preference being given to spacer groups in which Y is —O—($CH_2$)— where n=from 0 to 4, is —O—($C_6H_4$)—, is —NH—C$(CH_3)_2$— or —NH—CH($CH_2CH_3$)—.

These polymers are prepared by copolymerization of acrylic acid with an acrylic acid derivative containing sulfonic acid groups. Copolymerizing the acrylic acid derivative containing sulfonic acid groups with methacrylic acid leads to another polymer, the use of which is likewise preferred. The corresponding copolymers contain structural units of the formula XIII $$—[CH_2—C(CH_3)COOH]_m—[CH_2—CHC(O)—Y—SO_3H]_p— \quad (XIII)$$

in which m and p are each a whole natural number between 1 and 2,000, and Y is a spacer group which is selected from substituted or unsubstituted, aliphatic, aromatic or araliphatic hydrocarbon radicals having from 1 to 24 carbon atoms, preference being given to spacer groups in which Y is —O—($CH_2$)— where n=from 0 to 4, is —O—($C_6H_4$)—, is —NH—C$(CH_3)_2$— or —NH—CH($CH_2CH_3$)—.

Acrylic acid and/or methacrylic acid can also be copolymerized entirely analogously with methacrylic acid derivatives containing sulfonic acid groups, which changes the structural units within the molecule. Thus, copolymers which contain structural units of the formula XIV $$—[CH_2—CHCOOH]_m—[CH_2—C(CH_3)C(O)—Y—SO_3H]_p— \quad (XIV)$$

in which m and p are each a whole natural number between 1 and 2,000, and Y is a spacer group which is selected from substituted or unsubstituted, aliphatic, aromatic or araliphatic hydrocarbon radicals having from 1 to 24 carbon atoms, preference being given to spacer groups in which Y is —O—($CH_2$)— where n=from 0 to 4, is —O—($C_6H_4$)—, is —NH—C$(CH_3)_2$— or —NH—CH($CH_2CH_3$)—, are just as preferred as copolymers which contain structural units of the formula XV $$—[CH_2—C(CH_3)COOH]_m—[CH_2—C(CH_3)C(O)—Y—SO_3H]_p— \quad (XV)$$

in which m and p are each a whole natural number between 1 and 2,000, and Y is a spacer group which is selected from substituted or unsubstituted, aliphatic, aromatic or araliphatic hydrocarbon radicals having from 1 to 24 carbon atoms, preference being given to spacer groups in which Y is —O—($CH_2$)— where n=from 0 to 4, is —O—($C_6H_4$)—, is —NH—C$(CH_3)_2$— or —NH—CH($CH_2CH_3$)—.

Instead of acrylic acid and/or methacrylic acid, or in addition thereto, it is also possible to use maleic acid as a particularly preferred monomer from group i). This leads to copolymers which are preferred in accordance with the invention and contain structural units of the formula XVI $$—[HOOCCH—CHCOOH]_m—[CH_2—CHC(O)—Y—SO_3H]_p— \quad (XVI)$$

in which m and p are each a whole natural number between 1 and 2,000, and Y is a spacer group which is selected from substituted or unsubstituted, aliphatic, aromatic or araliphatic hydrocarbon radicals having from 1 to 24 carbon atoms, preference being given to spacer groups in which Y is —O—$(CH_2)$— where n=from 0 to 4, is —O—$(C_6H_4)$—, is —NH—$C(CH_3)_2$— or —NH—$CH(CH_2CH_3)$—, and to copolymers which are preferred in accordance with the invention and contain structural units of the formula XVII $$—[HOOCCH—CHCOOH]_m—[CH_2—C(CH_3)C(O)O—Y—SO_3H]_p— \quad (XVII)$$

in which m and p are each a whole natural number between 1 and 2,000, and Y is a spacer group which is selected from substituted or unsubstituted, aliphatic, aromatic or araliphatic hydrocarbon radicals having from 1 to 24 carbon atoms, preference being given to spacer groups in which Y is —O—$(CH_2)$— where n=from 0 to 4, is —O—$(C_6H_4)$—, is —NH—$C(CH_3)_2$— or —NH—$CH(CH_2CH_3)$—.

In summary, preference is given according to the invention to those copolymers which contain structural units of the formulas XII and/or XIII and/or XIV and/or XV and/or XVI and/or XVII $$—[CH_2—CHCOOH]_m—[CH_2—CHC(O)—Y—SO_3H]_p— \quad (XII)$$

$$—[CH_2—C(CH_3)COOH]_m—[CH_2—CHC(O)—Y—SO_3H]_p— \quad (XIII)$$

$$—[CH_2—CHCOOH]_m—[CH_2—C(CH_3)C(O)—Y—SO_3H]_p— \quad (XIV)$$

$$—[CH_2—C(CH_3)COOH]_m—[CH_2—C(CH_3)C(O)—Y—SO_3H]_p— \quad (XV)$$

$$—[HOOCCH—CHCOOH]_m—[CH_2—CHC(O)—Y—SO_3H]_p— \quad (XVI)$$

$$—[HOOCCH—CHCOOH]_m—[CH_2—C(CH_3)C(O)O—Y—SO_3H]_p— \quad (XVII)$$

in which m and p are each a whole natural number between 1 and 2,000, and Y is a spacer group which is selected from substituted or unsubstituted, aliphatic, aromatic or araliphatic hydrocarbon radicals having from 1 to 24 carbon atoms, preference being given to spacer groups in which Y is —O—$(CH_2)$— where n=from 0 to 4, is —O—$(C_6H_4)$—, is —NH—$C(CH_3)_2$— or —NH—$CH(CH_2CH_3)$—.

In the polymers, all or some of the sulfonic acid groups may be in neutralized form, i.e. the acidic hydrogen atom of the sulfonic acid group may be replaced in some or all of the sulfonic acid groups by metal ions, preferably alkali metal ions and, in particular, by sodium ions. The use of copolymers containing partially or completely neutralized sulfonic acid groups is preferred in accordance with the invention.

The monomer distribution of the copolymers used with preference in accordance with the invention is, in the case of copolymers which contain only monomers from groups i) and ii), preferably in each case from 5 to 95% by weight of i) or ii), more preferably from 50 to 90% by weight of monomer from group i) and from 10 to 50% by weight of monomer from group ii), based in each case on the polymer.

In the case of terpolymers, particular preference is given to those which contain from 20 to 85% by weight of monomer from group i), from 10 to 60% by weight of monomer from group ii), and from 5 to 30% by weight of monomer from group iii).

The molar mass of the sulfo copolymers used with preference according to the invention can be varied in order to adapt the properties of the polymers to the desired end use. Preferred washing or cleaning composition tablets are characterized in that the copolymers have molar masses of from 2,000 to 200,000 $gmol^{-1}$, preferably from 4,000 to 25,000 $gmol^{-1}$ and, in particular, from 5,000 to 15,000 $gmol^{-1}$.

Particular preference is further given to using amphoteric or cationic polymers. These particularly preferred polymers are characterized in that they have at least one positive charge. Such polymers are preferably water-soluble or water-dispersible, i.e. they have a solubility above 10 mg/ml in water at 25° C.

Particularly preferred cationic or amphoteric polymers contain at least one ethylenically unsaturated monomer unit of the general formula $$R^1(R^2)C{=}C(R^3)R^4$$

in which $R^1$ to $R^4$ are each independently —H, —$CH_3$, a straight-chain or branched, saturated alkyl radical having from 2 to 12 carbon atoms, a straight-chain or branched, mono- or polyunsaturated alkenyl radical having from 2 to 12 carbon atoms, alkyl or alkenyl radicals substituted by —$NH_2$, —OH or —COOH as defined above, a heteroatomic group having at least one positively charged group, a quaternized nitrogen atom or at least one amine group having a positive charge in the pH range between 2 and 11, or —COOH or —$COOR^5$ where $R^5$ is a saturated or unsaturated, straight-chain or branched hydrocarbon radical having from 1 to 12 carbon atoms.

Examples of the aforementioned (unpolymerized) monomer units are diallylamine, methyldiallylamine, dimethyldiallylammonium salts, acrylamidopropyl(trimethyl)ammonium salts ($R^1$, $R^2$ and $R^3$=H, $R^4$=$C(O)NH(CH_2)_2N^+(CH_3)_3X^-$), methacrylamidopropyl(trimethyl)-ammonium salts ($R^1$ and $R^2$=H, $R^3$=$CH_3$, H, $R^4$=$C(O)NH(CH_2)_2N^+(CH_3)_3X^-$).

Particular preference is given to using, as a constituent of the amphoteric polymers, unsaturated carboxylic acids of the general formula $$R^1(R^2)C{=}C(R^3)COOH$$

in which $R^1$ to $R^3$ are each independently —H, —$CH_3$, a straight-chain or branched, saturated alkyl radical having from 2 to 12 carbon atoms, a straight-chain or branched, mono- or polyunsaturated alkenyl radical having from 2 to 12 carbon atoms, alkyl or alkenyl radicals substituted by —$NH_2$, —OH or —COOH as defined above or —COOH or —$COOR^4$ where $R^4$ is a saturated or unsaturated, straight-chain or branched hydrocarbon radical having from 1 to 12 carbon atoms.

Particularly preferred amphoteric polymers contain, as monomer units, derivatives of diallylamine, in particular, dimethyldiallylammonium salt and/or methacrylamidopropyl (trimethyl)ammonium salt, preferably in the form of the chloride, bromide, iodide, hydroxide, phosphate, sulfate, hydrosulfate, ethylsulfate, methylsulfate, mesylate, tosylate, formate or acetate in combination with monomer units from the group of the ethylenically unsaturated carboxylic acids.

Bleaches

Among the compounds which serve as bleaches and supply $H_2O_2$ in water, sodium percarbonate is of particular significance. Further bleaches which can be used are, for example, sodium perborate tetrahydrate and sodium perborate monohydrate, peroxypyrophosphates, citrate perhydrates, and $H_2O_2$-supplying peracidic salts or peracids, such as perbenzoates, peroxophthalates, diperazelaic acid, phthaloimino peracid or diperdodecanedioic acid. According to the invention, it is also possible to use bleaches from the group of organic bleaches. Typical organic bleaches are the diacyl peroxides, for example, dibenzoyl peroxide. Further typical organic bleaches are the peroxy acids, particular examples being the alkyl peroxy acids and the aryl peroxy acids. Preferred representatives are (a) the peroxybenzoic acid and ring-substituted derivatives thereof, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid [phthaloiminoperoxy-hexanoic acid (PAP)], o-carboxybenzamido-peroxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid and N,N-terephthaloyldi(6-aminopercaproic acid).

Bleaches used may also be substances which release chlorine or bromine. Among suitable chlorine- or bromine-releasing materials, useful examples include heterocyclic N-bromoamides and N-chloroamides, for example, trichloroisocyanuric acid, tribromoisocyanuric acid, dibromoisocyanuric acid and/or dichloroisocyanuric acid (DICA) and/or salts thereof with cations such as potassium and sodium. Hydantoin compounds, such as 1,3-dichloro-5,5-dimethylhydantoin, are likewise suitable.

Bleach Activators

Bleach activators are used, for example, in washing or cleaning compositions, in order to achieve improved bleaching action when cleaning at temperatures of 60° C. and below. Bleach activators which may be used are compounds which, under perhydrolysis conditions, give rise to aliphatic peroxocarboxylic acids having preferably from 1 to 10 carbon atoms, in particular, from 2 to 4 carbon atoms, and/or optionally substituted perbenzoic acid. Suitable substances bear O-acyl and/or N-acyl groups of the number of carbon atoms specified, and/or optionally substituted benzoyl groups. Preference is given to polyacylated alkylenediamines, in particular, tetraacetylethylenediamine (TAED), acylated triazine derivatives, in particular, 1,5-diacetyl-2,4-dioxohexahydro-1,3,5-triazine (DADHT), acylated glycolurils, in particular, tetraacetylglycoluril (TAGU), N-acylimides, in particular, N-nonanoylsuccinimide (NOSI), acylated phenolsulfonates, in particular, n-nonanoyl- or isononanoyloxybenzenesulfonate (- or iso-NOBS), carboxylic anhydrides, in particular, phthalic anhydride, acylated polyhydric alcohols, in particular, triacetin, ethylene glycol diacetate and 2,5-diacetoxy-2,5-dihydrofuran.

Further bleach activators used with preference in the context of the present invention are compounds from the group of the cationic nitrites, especially cationic nitrites of the formula (XIV)

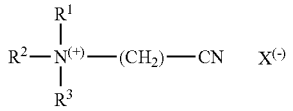

in which $R^1$ is —H, —$CH_3$, a $C_{2-24}$-alkyl or -alkenyl radical, a substituted $C_{2-24}$-alkyl or -alkenyl radical having at least one substituent from the group of —Cl, —Br, —OH, —$NH_2$, —CN, an alkyl- or alkenylaryl radical having a $C_{1-24}$-alkyl group, or is a substituted alkyl- or alkenylaryl radical having a $C_{1-24}$-alkyl group and at least one further substituent on the aromatic ring, $R^2$ and $R^3$ are each independently selected from —$CH_2$—CN, —$CH_3$, —$CH_2$—$CH_3$, —$CH_2$—$CH_2$—$CH_3$, —CH($CH_3$)—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, —($CH_2$—$CH_2$—O)$_n$H where n=1, 2, 3, 4, 5 or 6, and X is an anion.

Particular preference is given to a cationic nitrile of the formula (XI)

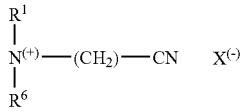

in which $R^4$, $R^5$ and $R^6$ are each independently selected from —$CH_3$, —$CH_2$—$CH_3$, —$CH_2$—$CH_2$—$CH_3$, —CH($CH_3$)—$CH_3$, where $R^4$ may additionally also be —H, and X is an anion, it being preferred that $R^5$=$R^6$=—$CH_3$ and, in particular, $R^4$=$R^5$=$R^6$=—$CH_3$, and particular preference being given to compounds of the formulas $(CH_3)_3N^{(+)}CH_2$—CN $X^-$, $(CH_3CH_2)_3N^{(+)}CH_2$—CN $X^-$, $(CH_3CH_2CH_2)_3N^{(+)}CH_2$—CN $X^-$, $(CH_3CH(CH_3))_3N^{(+)}CH_2$—CN $X^-$ or (HO—$CH_2$—$CH_2$)$_3N^{(+)}CH_2$—CN $X^-$, particular preference being given in turn, from this group of substances, to the cationic nitrile of the formula $(CH_3)_3N^{(+)}CH_2$—CN $X^-$ in which $X^-$ is an anion which is selected from the group of chloride, bromide, iodide, hydrogensulfate, methosulfate, p-toluenesulfonate (tosylate) or xylenesulfonate.

The bleach activators used may also be compounds which, under perhydrolysis conditions, give rise to aliphatic peroxocarboxylic acids having preferably from 1 to 10 carbon atoms, in particular, from 2 to 4 carbon atoms, and/or optionally substituted perbenzoic acid. Suitable substances bear O-acyl and/or N-acyl groups of the number of carbon atoms specified, and/or optionally substituted benzoyl groups. Preference is given to polyacylated alkylenediamines, in particular, tetraacetylethylenediamine (TAED), acylated triazine derivatives, in particular, 1,5-diacetyl-2,4-dioxohexahydro-1,3,5-triazine (DADHT), acylated glycolurils, in particular, tetraacetylglycoluril (TAGU), N-acylimides, in particular, N-nonanoylsuccinimide (NOSI), acylated phenolsulfonates, in particular, n-nonanoyl- or isononanoyloxybenzenesulfonate (- or iso-NOBS), carboxylic anhydrides, in particular, phthalic anhydride, acylated polyhydric alcohols, in particular, triacetin, ethylene glycol diacetate, 2,5-diacetoxy-2,5-dihydrofuran, n-methylmorpholiniumacetonitrile methylsulfate (MMA), and also acetylated sorbitol and mannitol or mixtures thereof (SORMAN), acylated sugar derivatives, in particular, pentaacetylglucose (PAG), pentaacetylfructose, tetraacetylxylose and octaacetyllactose, and acetylated, optionally N-alkylated, glucamine and gluconolactone, and/or N-acylated lactams, for example, N-benzoylcaprolactam. Hydrophilically substituted acylacetals and acyllactams are likewise used with preference. Combinations of conventional bleach activators can also be used.

In addition to the conventional bleach activators, or instead of them, it is also possible to use so-called bleach catalysts. These substances are bleach-boosting transition metal salts or transition metal complexes, for example, salen or carbonyl complexes of Mn, Fe, Co, Ru or Mo. It is also possible to use complexes of Mn, Fe, Co, Ru, Mo, Ti, V and Cu with N-containing tripod ligands, and also Co-, Fe-, Cu- and Ru-ammine complexes as bleach catalysts.

When further bleach activators are to be used in addition to the nitrile quats, preference is given to using bleach activators from the group of the polyacylated alkylenediamines, in particular, tetraacetylethylenediamine (TAED), N-acylimides, in particular, N-nonanoylsuccinimide (NOSI), acylated phenolsulfonates, in particular, n-nonanoyl- or isononanoyloxybenzenesulfonate (- or iso-NOBS), n-methylmorpholiniumacetonitrile methylsulfate (MMA), preferably in amounts up to 10% by weight, in particular, from 0.1% by weight to 8% by weight, particularly from 2 to 8% by weight and more preferably from 2 to 6% by weight, based in each case on the total weight of the composition containing bleach activator.

Bleach-boosting transition metal complexes, in particular, with the central atoms Mn, Fe, Co, Cu, Mo, V, Ti and/or Ru, preferably selected from the group of manganese and/or cobalt salts and/or complexes, more preferably the cobalt (ammine) complexes, the cobalt (acetate) complexes, the cobalt (carbonyl) complexes, the chlorides of cobalt or manganese, and manganese sulfate, are used in customary amounts, preferably in an amount up to 5% by weight, in particular, from 0.0025% by weight to 1% by weight and more preferably from 0.01% by weight to 0.25% by weight, based in each case on the total weight of the composition containing bleach activator. In specific cases, though, it is also possible to use a greater amount of bleach activator.

Glass Corrosion Inhibitors

Glass corrosion inhibitors prevent the occurrence of cloudiness, smears and scratches, but also the iridescence of the glass surface of machine-cleaned glasses. Preferred glass corrosion inhibitors stem from the group of the magnesium and/or zinc salts and/or magnesium and/or zinc complexes.

A preferred class of compounds which can be used to prevent glass corrosion is that of insoluble zinc salts.

In the context of this preferred embodiment, insoluble zinc salts are zinc salts which have a maximum solubility of 10 grams of zinc salt per liter of water at 20° C. Examples of insoluble zinc salts which are particularly preferred in accordance with the invention are zinc silicate, zinc carbonate, zinc oxide, basic zinc carbonate ($Zn_2(OH)_2CO_3$), zinc hydroxide, zinc oxalate, zinc monophosphate ($Zn_3(PO_4)_2$) and zinc pyrophosphate ($Zn_2(P_2O_7)$).

The zinc compounds mentioned are preferably used in amounts which bring about a content of zinc ions in the compositions of between 0.02 and 10% by weight, preferably between 0.1 and 5.0% by weight and, in particular, between 0.2 and 1.0% by weight, based in each case on the overall composition containing glass corrosion inhibitor. The exact content in the compositions of the zinc salt or the zinc salts is by its nature dependent on the type of the zinc salts—the less soluble the zinc salt used, the higher its concentration in the inventive compositions.

Since the insoluble zinc salts remain for the most part unchanged during the dishwashing operation, the particle size of the salts is a criterion to be considered, so that the salts do not adhere to glassware or parts of the machine. Preference is given here to compositions in which the insoluble zinc salts have a particle size below 1.7 millimeters.

When the maximum particle size of the insoluble zinc salts is less than 1.7 mm, there is no risk of insoluble residues in the dishwasher. The insoluble zinc salt preferably has an average particle size which is distinctly below this value in order to further minimize the risk of insoluble residues, for example, an average particle size of less than 250 μm. The lower the solubility of the zinc salt, the more important this is. In addition, the glass corrosion-inhibiting effectiveness increases with decreasing particle size. In the case of very sparingly soluble zinc salts, the average particle size is preferably below 100 μm. For even more sparingly soluble salts, it may be lower still; for example, average particle sizes below 100 μm are preferred for the very sparingly soluble zinc oxide.

A further preferred class of compounds is that of magnesium and/or zinc salt(s) of at least one monomeric and/or polymeric organic acid. These have the effect that, even upon repeated use, the surfaces of glassware are not altered as a result of corrosion, and, in particular, no cloudiness, smears or scratches, and also no iridescence of the glass surfaces, are caused.

Even though all magnesium and/or zinc salt(s) of monomeric and/or polymeric organic acids may be used, preference is given, as described above, to the magnesium and/or zinc salts of monomeric and/or polymeric organic acids from the groups of the unbranched, saturated or unsaturated monocarboxylic acids, the branched, saturated or unsaturated monocarboxylic acids, the saturated and unsaturated dicarboxylic acids, the aromatic mono-, di- and tricarboxylic acids, the sugar acids, the hydroxy acids, the oxo acids, the amino acids and/or the polymeric carboxylic acids.

The spectrum of the zinc salts, preferred in accordance with the invention, of organic acids, preferably of organic carboxylic acids, ranges from salts which are sparingly soluble or insoluble in water, i.e. have a solubility below 100 mg/l, preferably below 10 mg/l, in particular, have zero solubility, to those salts which have a solubility in water above 100 mg/l, preferably above 500 mg/l, more preferably above 1 g/l and, in particular, above 5 g/l (all solubilities at water temperature 20° C.). The first group of zinc salts includes, for example, zinc citrate, zinc oleate and zinc stearate; the group of soluble zinc salts includes, for example, zinc formate, zinc acetate, zinc lactate and zinc gluconate.

With particular preference, the glass corrosion inhibitor used is at least one zinc salt of an organic carboxylic acid, more preferably a zinc salt from the group of zinc stearate, zinc oleate, zinc gluconate, zinc acetate, zinc lactate and/or zinc citrate. Preference is also given to zinc ricinoleate, zinc abietate and zinc oxalate.

In the context of the present invention, the content of zinc salt in cleaning compositions is preferably between 0.1 and 5% by weight, preferably between 0.2 and 4% by weight and, in particular, between 0.4 and 3% by weight, or the content of zinc in oxidized form (calculated as $Zn^{2+}$) is between 0.01 and 1% by weight, preferably between 0.02 and 0.5% by weight and, in particular, between 0.04 and 0.2% by weight, based in each case on the total weight of the composition containing glass corrosion inhibitor.

Corrosion Inhibitors

Corrosion inhibitors serve to protect the ware or the machine, particularly silver protectants having particular significance in the field of machine dishwashing. It is possible to use the known substances from the prior art. In general, it is possible, in particular, to use silver protectants selected from the group of the triazoles, the benzotriazoles, the bisbenzotriazoles, the aminotriazoles, the alkylaminotriazoles and the transition metal salts or complexes. Particular preference is given to using benzotriazole and/or alkylaminotriazole. Examples of the 3-amino-5-alkyl-1,2,4-triazoles to be used with preference in accordance with the invention include: 5-propyl-, -butyl-, -pentyl-, -heptyl-, -octyl-, -nonyl-, -decyl-, -undecyl-, -dodecyl-, -isononyl-, -Versatic-10 acid alkyl-, -phenyl-, -p-tolyl-, -(4-tert-butylphenyl)-, -(4-methoxyphenyl)-, -(2-, -3-, 4-pyridyl)-, -(2-thienyl)-, -(5-methyl-2-furyl)-, -(5-oxo-2-pyrrolidinyl)-3-amino-1,2,4-triazole. In machine dishwasher detergents, the alkylamino-1,2,4-triazoles or their physiologically compatible salts are used in a concentration of from 0.001 to 10% by weight, preferably from 0.0025 to 2% by weight, more preferably from 0.01 to 0.04% by weight. Preferred acids for the salt formation are hydrochloric acid, sulfuric acid, phosphoric acid, carbonic acid, sulfurous acid, organic carboxylic acids such as acetic acid, glycolic acid, citric acid, succinic acid. Very particularly effective are 5-pentyl-, 5-heptyl-, 5-nonyl-, 5-undecyl-, 5-isononyl-, 5-Versatic-10 acid alkyl-3-amino-1,2,4-triazoles, and also mixtures of these substances.

Frequently also found in cleaning formulations are active chlorine-containing agents which can significantly reduce the corrosion of the silver surface. In chlorine-free cleaners, particularly oxygen- and nitrogen-containing organic redox-active compounds, such as di- and trihydric phenols, for example, hydroquinone, pyrocatechol, hydroxyhydroquinone, gallic acid, phloroglucinol, pyrogallol and derivatives of these classes of compound. Salt- and complex-type inorganic compounds, such as salts of the metals Mn, Ti, Zr, Hf, V, Co and Ce, also frequently find use. Preference is given in this context to the transition metal salts which are selected from the group of manganese and/or cobalt salts and/or complexes, more preferably cobalt (ammine) complexes, cobalt (acetate) complexes, cobalt (carbonyl) complexes, the chlorides of cobalt or manganese, and manganese sulfate. Zinc compounds may likewise be used to prevent corrosion on the ware.

Instead of or in addition to the above-described silver protectants, for example, the benzotriazoles, it is possible to use redox-active substances. These substances are preferably inorganic redox-active substances from the group of the manganese, titanium, zirconium, hafnium, vanadium, cobalt and cerium salts and/or complexes, the metals preferably being in one of the oxidation states II, III, IV, V or VI.

The metal salts or metal complexes used should be at least partially soluble in water. The counterions suitable for the salt formation include all customary singly, doubly or triply negatively charged inorganic anions, for example, oxide, sulfate, nitrate, fluoride, but also organic anions, for example, stearate.

Metal complexes in the context of the invention are compounds which consist of a central atom and one or more ligands, and optionally additionally one or more of the above-mentioned anions. The central atom is one of the above-mentioned metals in one of the above-mentioned oxidation states. The ligands are neutral molecules or anions which are mono- or polydentate; the term "ligands" in the context of the invention is explained in more detail, for example, in Römpp Chemie Lexikon, Georg Thieme Verlag, Stuttgart/N.Y., 9th edition, 1990, page 2507. When the charge of the central atom and the charge of the ligand(s) within a metal complex do not add up to zero, depending on whether there is a cationic or an anionic charge excess, either one or more of the above-mentioned anions or one or more cations, for example, sodium, potassium, ammonium ions, ensure that the charge balances. Suitable complexing agents are, for example, citrate, acetyl acetonate or 1-hydroxyethane-1,1-diphosphonate.

The definition of "oxidation state" customary in chemistry is reproduced, for example, in Römpp Chemie Lexikon, Georg Thieme Verlag, Stuttgart/N.Y., 9th edition, 1991, page 3168.

Particularly preferred metal salts and/or metal complexes are selected from the group of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$, and mixtures thereof, so that preferred inventive machine dishwasher detergents are characterized in that the metal salts and/or metal complexes are selected from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$.

These metal salts or metal complexes are generally commercial substances which can be used in the inventive washing or cleaning compositions for the purposes of silver corrosion protection without prior cleaning. For example, the mixture of penta- and tetravalent vanadium ($V_2O_5$, $VO_2$, $V_2O_4$) known from the preparation of $SO_3$ (contact process) is therefore suitable, as is the titanyl sulfate, $TiOSO_4$, which is obtained by diluting a $Ti(SO_4)_2$ solution.

The inorganic redox-active substances, especially metal salts or metal complexes, are preferably coated, i.e. covered completely with a material which is water-tight, but slightly soluble at the cleaning temperatures, in order to prevent their premature disintegration or oxidation in the course of storage. Preferred coating materials which are applied by known methods, for instance by the melt coating method according to Sandwik from the foods industry, are paraffins, microcrystalline waxes, waxes of natural origin, such as carnauba wax, candelilla wax, beeswax, relatively high-melting alcohols, for example, hexadecanol, soaps or fatty acids. The coating material which is solid at room temperature is applied to the material to be coated in the molten state, for example, by centrifuging finely divided material to be coated in a continuous stream through a likewise continuously generated spray-mist zone of the molten coating material. The melting point has to be selected such that the coating material readily dissolves or rapidly melts during the silver treatment. The melting point should ideally be in the range between 45° C. and 65° C. and preferably in the 50° C. to 60° C. range.

The metal salts and/or metal complexes mentioned are present in cleaning compositions preferably in an amount of from 0.05 to 6% by weight, preferably from 0.2 to 2.5% by weight, based in each case on the overall composition containing corrosion inhibitor.

Enzymes

To increase the washing or cleaning performance of washing or cleaning compositions, it is possible to use enzymes. These include, in particular, proteases, amylases, lipases, hemicellulases, cellulases or oxidoreductases, and preferably mixtures thereof. These enzymes are in principle of natural origin; starting from the natural molecules, improved variants are available for use in washing and cleaning compositions and are preferably used accordingly. Washing or cleaning compositions preferably contain enzymes in total amounts of from $1\times10^{-6}$ to 5 percent by weight based on active protein.

The protein concentration may be determined with the aid of known methods, for example, the BCA method or the biuret method.

Among the proteases, preference is given to those of the subtilisin type. Examples thereof include the subtilisins BPN' and Carlsberg, protease PB92, the subtilisins 147 and 309, *Bacillus lentus* alkaline protease, subtilisin DY and the enzymes thermitase and proteinase K which can be classified to the subtilases but no longer to the subtilisins in the narrower sense, and the proteases TW3 and TW7. The subtilisin Carlsberg is available in a developed form under the trade name Alcalase® from Novozymes A/S, Bagsvaerd, Denmark. The subtilisins 147 and 309 are sold under the trade names Esperase® and Savinase® respectively by Novozymes. The variants listed under the name BLAP® are derived from the protease of *Bacillus lentus* DSM 5483.

Further examples of useful proteases are the enzymes available under the trade names Durazym®, Relase®, Everlase®, Nafizym, Natalase®, Kannase® and Ovozymes® from Novozymes, those under the trade names Purafect®, Purafect®OxP and Properase® from Genencor, that under the trade name Protosol® from Advanced Biochemicals Ltd., Thane, India, that under the trade name Wuxi® from Wuxi Snyder Bioproducts Ltd., China, those under the trade names Proleather® and Protease P® from Amano Pharmaceuticals Ltd., Nagoya, Japan and that under the name Proteinase K-16 from Kao Corp., Tokyo, Japan.

Examples of amylases which can be used in accordance with the invention are the α-amylases from *Bacillus licheniformis*, from *B. amyloliquefaciens* or from *B. stearothermophilus* and developments thereof which have been improved for use in washing and cleaning compositions. The *B. licheniformis* enzyme is available from Novozymes under the name Termamyl® and from Genencor under the name Purastar®ST. Development products of this α-amylase are obtainable from Novozymes under the trade names Duramyl® and Termamyl®ultra, from Genencor under the name Purastar®OxAm and from Daiwa Seiko Inc., Tokyo, Japan as Keistase®. The *B. amyloliquefaciens* α-amylase is sold by Novozymes under the name BAN®, and variants derived from the *B. stearothermophilus* α-amylase under the names BSG® and Novamyl®, likewise from Novozymes.

Enzymes which should additionally be emphasized for this purpose are the α-amylase from *Bacillus* sp. A 7-7 (DSM 12368), and the cyclodextrin glucanotransferase (CGTase) from *B. agaradherens* (DSM 9948).

Also suitable are the developments of α-amylase from *Aspergillus niger* and *A. oryzae*, which are available under the trade names Fungamyl® from Novozymes. Another commercial product is Amylase-LT®, for example.

Furthermore, lipases or cutinases may be used according to the invention, especially owing to their triglyceride-cleaving activities, but also in order to generate peracids in situ from suitable precursors. Examples thereof include the lipases which were originally obtainable from *Humicola lanuginosa* (*Thermomyces lanuginosus*) or have been developed, in particular, those with the D96L amino acid substitution. They are sold, for example, under the trade names Lipolase®, Lipolase®Ultra, LipoPrime®, Lipozyme® and Lipex® from Novozymes. It is additionally possible, for example, to use the cutinases which have originally been isolated from *Fusarium solani pisi* and *Humicola insolens*. Lipases which are also useful can be obtained under the designations Lipase CE®, Lipase P®, Lipase B®, Lipase CES®, Lipase AKG®, *Bacillis* sp. Lipase®, Lipase AP®, Lipase M-AP® and Lipase AML® from Amano. Examples of lipases and cutinases from Genencor which can be used are those whose starting enzymes have originally been isolated from *Pseudomonas mendocina* and *Fusarium solanii*. Other important commercial products include the M1 Lipase® and Lipomax® preparations originally sold by Gist-Brocades and the enzymes sold under the names Lipase MY-30®, Lipase OF® and Lipase PL® by Meito Sangyo KK, Japan, and also the product Lumafast® from Genencor.

It is also possible to use enzymes which are combined under the term "hemicellulases." These include, for example, mannanases, xanthane lyases, pectin lyases (=pectinases), pectin esterases, pectate lyases, xyloglucanases (=xylanases), pullulanases and β-glucanases. Suitable mannanases are available, for example, under the names Gamanase® and Pektinex AR® from Novozymes, under the name Rohapec® B1L from AB Enzymes and under the name Pyrolase® from Diversa Corp., San Diego, Calif., USA. The βglucanase obtained from *B. subtilis* is available under the name Cereflo® from Novozymes.

To enhance the bleaching action, it is possible in accordance with the invention to use comprise oxidoreductases, for example, oxidases, oxygenases, catalases, peroxidases, such as haloperoxidases, chloroperoxidases, bromoperoxidases, lignin peroxidases, glucose peroxidases or manganese peroxidases, dioxygenases or laccases (phenol oxidases, polyphenol oxidases). Suitable commercial products include Denilite® 1 and 2 from Novozymes. Advantageously, preferably organic, more preferably aromatic, compounds which interact with the enzymes are additionally added in order to enhance the activity of the oxidoreductases concerned (enhancers), or to ensure the electron flux in the event of large differences in the redox potentials of the oxidizing enzymes and the soilings (mediators).

The enzymes derive, for example, either originally from microorganisms, for example, of the genera *Bacillus, Streptomyces, Humicola*, or *Pseudomonas*, and/or are produced in biotechnology processes known per se by suitable microorganisms, for instance by transgenic expression hosts of the genera *Bacillus* or filamentous fungi.

The enzymes in question are favorably purified via processes which are established per se, for example, via precipitation, sedimentation, concentration, filtration of the liquid phases, microfiltration, ultrafiltration, the action of chemicals, deodorization or suitable combinations of these steps.

The enzymes may be used in any form established in the prior art. These include, for example, the solid preparations obtained by granulation, extrusion or lyophilization, or, especially in the case of liquid or gel-form compositions, solutions of the enzymes, advantageously highly concentrated, low in water and/or admixed with stabilizers.

Alternatively, the enzymes may be encapsulated either for the solid or for the liquid administration form, for example, by spray-drying or extrusion of the enzyme solution together with a preferably natural polymer, or in the form of capsules, for example, those in which the enzymes are enclosed as in a solidified gel, or in those of the core-shell type, in which an enzyme-containing core is coated with a water-, air- and/or chemical-impermeable protective layer. It is possible in layers applied thereto to additionally apply further active ingredients, for example, stabilizers, emulsifiers, pigments, bleaches or dyes. Such capsules are applied by methods known per se, for example, by agitated or roll granulation or in fluidized bed processes. Advantageously, such granules, for example, as a result of application of polymeric film formers, are low-dusting and storage-stable owing to the coating.

It is also possible to formulate two or more enzymes together, so that a single granule has a plurality of enzyme activities.

A protein and/or enzyme may be protected, particularly during storage, from damage, for example, inactivation, denaturation or decay, for instance by physical influences, oxidation or proteolytic cleavage. When the proteins and/or enzymes are obtained microbially, particular preference is given to inhibiting proteolysis, especially when the compositions also comprise proteases.

One group of stabilizers is that of reversible protease inhibitors. Frequently, benzamidine hydrochloride, borax, boric acids, boronic acids or salts or esters thereof are used, and of these, in particular, derivatives having aromatic groups, for example, ortho-substituted, meta-substituted and para-substituted phenylboronic acids, or the salts or esters thereof. Peptidic protease inhibitors which should be mentioned include ovomucoid and leupeptin; an additional option is the formation of fusion proteins of proteases and peptide inhibitors.

Further enzyme stabilizers are amino alcohols such as mono-, di-, triethanol- and -propanolamine and mixtures thereof, aliphatic carboxylic acids up to $C_{12}$, such as succinic acid, other dicarboxylic acids or salts of the acids mentioned. Terminally capped fatty acid amide alkoxylates are also suitable as stabilizers. Certain organic acids used as builders are additionally capable of stabilizing an enzyme present.

Lower aliphatic alcohols, but, in particular, polyols, for example, glycerol, ethylene glycol, propylene glycol or sorbitol, are other frequently used enzyme stabilizers. Calcium salts are likewise used, for example, calcium acetate or calcium formate, as are magnesium salts.

Polyamide oligomers or polymeric compounds such as lignin, water-soluble vinyl copolymers or cellulose ethers, acrylic polymers and/or polyamides stabilize the enzyme preparation against influences including physical influences or pH fluctuations. Polyamine N-oxide-containing polymers act simultaneously as enzyme stabilizers. Other polymeric stabilizers are the linear $C_8$-$C_{18}$ polyoxyalkylenes. Alkylpolyglycosides can likewise stabilize the enzymatic components of the inventive composition and even increase their performance. Crosslinked N-containing compounds likewise act as enzyme stabilizers.

Reducing agents and antioxidants increase the stability of the enzymes against oxidative decay. An example of a sulfur-containing reducing agent is sodium sulfite.

Preference is given to using combinations of stabilizers, for example, of polyols, boric acid and/or borax, the combination of boric acid or borate, reducing salts and succinic acid or other dicarboxylic acids or the combination of boric acid or borate with polyols or polyamino compounds and with reducing salts. The action of peptide-aldehyde stabilizers is increased by the combination with boric acid and/or boric acid derivatives and polyols, and further enhanced by the additional use of divalent cations, for example, calcium ions.

Preference is given to using one or more enzymes and/or enzyme preparations, preferably solid protease preparations and/or amylase preparations, in amounts of from 0.1 to 5% by weight, preferably of from 0.2 to 4.5% by weight and, in particular, from 0.4 to 4% by weight, based in each case on the overall composition containing enzyme.

Disintegration Assistants

In order to ease the decomposition of prefabricated tablets, it is possible to incorporate disintegration assistants, known as tablet disintegrants, into these compositions, in order to shorten disintegration times. According to Römpp (9th edition, vol. 6, p. 4440) and Voigt Lehrbuch der pharmazeutischen Technologie [Textbook of pharmaceutical technology] (6th edition, 1987, p. 182-184), tablet disintegrants or disintegration accelerants refer to assistants which ensure the rapid decomposition of tablets in water or gastric juice and the release of pharmaceuticals in absorbable form.

These substances, which are also referred to as "breakup" agents owing to their action, increase their volume on ingress of water, and it is either the increase in the intrinsic volume (swelling) or the release of gases that can generate a pressure that causes the tablets to disintegrate into smaller particles. Disintegration assistants which have been known for some time are, for example, carbonate/citric acid systems, although other organic acids may also be used. Swelling disintegration assistants are, for example, synthetic polymers such as polyvinylpyrrolidone (PVP) or natural polymers or modified natural substances such as cellulose and starch and derivatives thereof, alginates or casein derivatives.

Preference is given to using disintegration assistants in amounts of from 0.5 to 10% by weight, preferably from 3 to 7% by weight and, in particular, from 4 to 6% by weight, based in each case on the total weight of the composition comprising disintegration assistant.

Preferred disintegrants used in the context of the present invention are disintegrants based on cellulose, so that preferred washing and cleaning composition tablets contain such a cellulose-based disintegrant in amounts of from 0.5 to 10% by weight, preferably from 3 to 7% by weight and, in particular, from 4 to 6% by weight. Pure cellulose has the formal empirical composition $(C_6H_{10}O_5)_n$ and, viewed in a formal sense, is a β-1,4-polyacetal of cellobiose which is in turn formed from two molecules of glucose. Suitable celluloses consist of from approximately 500 to 5,000 glucose units and accordingly have average molar masses of from 50,000 to 500,000. Useful cellulose-based disintegrants in the context of the present invention are also cellulose derivatives which are obtainable by polymer-like reactions from cellulose. Such chemically modified celluloses comprise, for example, products of esterifications and etherifications in which hydroxyl hydrogen atoms have been substituted. However, celluloses in which the hydroxyl groups have been replaced by functional groups which are not bonded via an oxygen atom can also be used as cellulose derivatives. The group of the cellulose derivatives includes, for example, alkali metal celluloses, carboxymethylcelluloses (CMC), cellulose esters and ethers, and amino celluloses. The cellulose derivatives mentioned are preferably not used alone as disintegrants based on cellulose, but rather in a mixture with cellulose. The content of cellulose derivatives in these mixtures is preferably below 50% by weight, more preferably below 20% by weight, based on the disintegrant based on cellulose. The disintegrant based on cellulose which is used is more preferably pure cellulose, which is free of cellulose derivatives.

The cellulose used as a disintegration assistant is preferably not used in finely divided form, but rather converted to a coarser form before admixing with the premixtures to be compressed, for example, granulated or compacted. The particle sizes of such disintegrants are usually above 200 μm, preferably to an extent of at least 90% by weight between 300 and 1,600 μm and, in particular, to an extent of at least 90% by weight between 400 and 1,200 μm. The aforementioned coarser cellulose-based disintegration assistants which are described in detail in the documents cited are to be used with preference as disintegration assistants in the context of the present invention and are commercially available, for example, under the name Arbocel® TF-30-HG from Rettenmaier.

As a further cellulose-based disintegrant or as a constituent of this component, it is possible to use microcrystalline cellulose. This microcrystalline cellulose is obtained by partial hydrolysis of celluloses under conditions which attack and fully dissolve only the amorphous regions (approximately 30% of the total cellulose mass) of the celluloses, but leave the crystalline regions (approximately 70%) undamaged. A subsequent deaggregation of the microfine celluloses formed by the hydrolysis affords the microcrystalline celluloses which have primary particle sizes of approximately 5 μm and can be compacted, for example, to granules having an average particle size of 200 μm.

Disintegration assistants preferred in the context of the present invention, preferably a cellulose-based disintegration assistant, preferably in granulated, cogranulated or compacted form, are present in the compositions containing disintegrant in amounts of from 0.5 to 10% by weight, preferably from 3 to 7% by weight and, in particular, from 4 to 6% by weight, based in each case on the total weight of the composition containing disintegrant.

According to the invention, gas-evolving effervescent systems may preferably additionally be used as tablet disintegrants. The gas-evolving effervescent system may consist of a single substance which releases a gas on contact with water. Among these compounds, mention should be made of magnesium peroxide, in particular, which releases oxygen on contact with water. Typically, however, the gas-releasing effervescent system itself consists of at least two constituents which react with one another to form gas. While a multitude of systems which release, for example, nitrogen, oxygen or hydrogen are conceivable and practicable here, the effervescent system used in the inventive washing and cleaning composition tablets will be selectable on the basis of both economic and on the basis of environmental considerations. Preferred effervescent systems consist of alkali metal carbonate and/or alkali metal hydrogencarbonate and of an acidifier which is suitable for releasing carbon dioxide from the alkali metal salts in aqueous solution.

In the case of the alkali metal carbonates and/or alkali metal hydrogencarbonates, the sodium and potassium salts are distinctly preferred over the other salts for reasons of cost. It is of course not mandatory to use the pure alkali metal carbonates or alkali metal hydrogencarbonates in question; rather, mixtures of different carbonates and hydrogencarbonates may be preferred.

The effervescent system used is preferably from 2 to 20% by weight, preferably from 3 to 15% by weight and, in particular, from 5 to 10% by weight of an alkali metal carbonate or alkali metal hydrogencarbonate, and from 1 to 15% by weight, preferably from 2 to 12% by weight and, in particular, from 3 to 10% by weight of an acidifier, based in each case on the overall weight of the composition.

Acidifiers which release carbon dioxide from the alkali metal salts in aqueous solution and can be used are, for example, boric acid and also alkali metal hydrogensulfates, alkali metal dihydrogenphosphates and other inorganic salts. Preference is given, however, to the use of organic acidifiers, citric acid being a particularly preferred acidifier. However, it is also possible, in particular, to use the other solid mono-, oligo- and polycarboxylic acids. From this group, preference is given in turn to tartaric acid, succinic acid, malonic acid, adipic acid, maleic acid, fumaric acid, oxalic acid, and polyacrylic acid. It is likewise possible to use organic sulfonic acids such as amidosulfonic acid. A commercially available acidifier which can likewise be used with preference in the context of the present invention is Sokalan® DCS (trademark of BASF), a mixture of succinic acid (max. 31% by weight), glutaric acid (max. 50% by weight) and adipic acid (max. 33% by weight).

In the context of the present invention, preference is given to acidifiers in the effervescent system from the group of the organic di-, tri- and oligocarboxylic acids, or mixtures of these.

Fragrances

The perfume oils and/or fragrances used may be individual odorant compounds, for example, the synthetic products of the ester, ether, aldehyde, ketone, alcohol and hydrocarbon type. Odorant compounds of the ester type are, for example, benzyl acetate, phenoxyethyl isobutyrate, p-tert-butylcyclohexyl acetate, linalyl acetate, dimethylbenzyl-carbinyl acetate, phenylethyl acetate, linalyl benzoate, benzyl formate, ethyl methyl phenylglycinate, allyl cyclohexylpropionate, styrallyl propionate and benzyl salicylate. The ethers include, for example, benzyl ethyl ether; the aldehydes include, for example, the linear alkanals having 8-18 carbon atoms, citral, citronellal, citronellyloxyacetaldehyde, cyclamen aldehyde, hydroxycitronellal, lilial and bourgeonal; the ketones include, for example, the ionones, α-isomethylionone and methyl cedryl ketone; the alcohols include anethole, citronellol, eugenol, geraniol, linalool, phenylethyl alcohol and terpineol; the hydrocarbons include primarily the terpenes such as limonene and pinene. However, preference is given to using mixtures of different odorants which together produce a pleasing fragrance note. Such perfume oils may also comprise natural odorant mixtures, as are obtainable from vegetable sources, for example, pine oil, citrus oil, jasmine oil, patchouli oil, rose oil or ylang-ylang oil. Likewise suitable are muscatel, sage oil, chamomile oil, clove oil, balm oil, mint oil, cinnamon leaf oil, lime blossom oil, juniper berry oil, vetiver oil, olibanum oil, galbanum oil and labdanum oil, and also orange blossom oil, neroli oil, orange peel oil and sandalwood oil.

The fragrances can be processed directly, but it may also be advantageous to apply the fragrances to carriers which ensure long-lasting fragrance by slower fragrance release. Useful such carrier materials have been found to be, for example, cyclodextrins, and the cyclodextrin-perfume complexes may additionally also be coated with further assistants.

Dyes

Preferred dyes, whose selection presents no difficulty at all to the person skilled in the art, have high storage stability and insensitivity toward the other ingredients of the compositions and to light, and also have no pronounced substantivity toward the substrates to be treated with the dye-containing compositions, such as glass, ceramics, plastic dishes or textiles, so as not to stain them.

Solvents

The solvents include especially the nonaqueous organic solvents, particular preference being given to using nonaqueous solvents from the group of mono- or polyhydric alcohols, alkanolamines or glycol ethers, provided that they are miscible with water in the concentration range specified. The solvents are preferably selected from ethanol, - or i-propanol, butanols, glycol, propane- or butanediol, glycerol, diglycol, propyl- or butyldiglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol methyl or ethyl ether, methoxy-, ethoxy- or butoxytriglycol, 1-butoxyethoxy-2-propanol, 3-methyl-3-methoxybutanol, propylene glycol t-butyl ether, and mixtures of these solvents.

Foam Inhibitors

Useful foam inhibitors are, for example, soaps, paraffins or silicone oils, which may optionally be applied to carrier materials. Suitable antiredeposition agents, which are also referred to as soil repellents, are, for example, nonionic cellulose ethers, such as methylcellulose and methylhydroxypropylcellulose having a proportion of methoxy groups of from 15 to 30% by weight and of hydroxypropyl groups of from 1 to 15% by weight, based in each case on the nonionic cellulose ethers, and the prior art polymers of phthalic acid and/or terephthalic acid or derivatives thereof, in particular, polymers of ethylene terephthalates and/or polyethylene glycol terephthalates or anionically and/or nonionically modified derivatives thereof. Of these, particular preference is given to the sulfonated derivatives of phthalic acid polymers and terephthalic acid polymers.

Optical Brighteners

Optical brighteners (known as "whiteners") may be added to washing or cleaning compositions in order to eliminate graying and yellowing of textiles treated with these compositions. These substances attach to the fibers and bring about brightening and simulated bleaching action by converting invisible ultraviolet radiation to visible longer-wavelength light, in the course of which the ultraviolet light absorbed from sunlight is radiated as pale bluish fluorescence and, together with the yellow shade of the grayed or yellowed laundry, results in pure white. Suitable compounds stem, for example, from the substance classes of 4,4'-diamino-2,2'-stilbenedisulfonic acids (flavonic acids), 4,4'-distyrylbiphenyls, methylumbelliferones, coumarins, dihydroquinolinones, 1,3-diarylpyrazolines, naphthalimides, benzoxazole, benzisoxazole and benzimidazole systems, and the pyrene derivatives substituted by heterocycles.

Graying Inhibitors

Graying inhibitors in textile cleaning compositions have the task of keeping the soil detached from the fiber suspended in the liquor, thus preventing the soil from reattaching. Suitable for this purpose are water-soluble colloids, usually of organic nature, for example, the water-soluble salts of polymeric carboxylic acids, size, gelatin, salts of ether sulfonic acids of starch or of cellulose, or salts of acidic sulfuric esters of cellulose or of starch. Water-soluble polyamides containing acidic groups are also suitable for this purpose. In addition, it is possible to use soluble starch preparations, and starch products other than those mentioned above, for example, degraded starch, aldehyde starches, etc. It is also possible to use polyvinylpyrrolidone. Also usable as graying inhibitors in the particulate compositions are cellulose ethers such as carboxymethylcellulose (sodium salt), methylcellulose, hydroxyalkylcellulose and mixed ethers such as methylhydroxyethyl-cellulose, methylhydroxypropylcellulose, methylcarboxymethylcellulose and mixtures thereof.

Active Antimicrobial Ingredients

Active antimicrobial ingredients serve to control microorganisms. A distinction is drawn here, depending on the antimicrobial spectrum and mechanism of action, between bacteriostats and bactericides, fungistats and fungicides, etc. Important substances from these groups are, for example, benzalkonium chlorides, alkylarylsulfonates, halophenols and phenylmercuric acetate, although it is also possible to dispense entirely with these agents.

Apart from for the packaging of washing or cleaning compositions, the process according to the invention may also be used for the packaging of active substances or active substance mixtures from the group of cosmetics, pharmaceuticals, bodycare compositions, agrochemical assistants, adhesives, surface treatment compositions, building materials, dyes or foods.

In the context of the present application, "pharmaceuticals" is a collective term which (in a wider sense than the terms "drugs" or "chemotherapeutics") has substantially the same meaning as the term "medicament," and encompasses active substances and therapeutic substances and also their carriers in the various medicament forms. Pharmaceuticals are accordingly substances and formulations of substances which are intended, by application on or in the human or animal body, to heal, to alleviate, to prevent or to recognize disorders, diseases, body damage or pathological conditions, to allow the recognition of the condition, the state or the functions of the body or mental states, to replace active substances or bodily fluids generated by the human or animal body, to repel, to eliminate or to make harmless pathogens, parasites or exogenous substances, or to influence the condition, the state or the function of the body or mental states. Pharmaceuticals are generally chemical elements and chemical compounds and their naturally occurring mixtures and solutions, plants, plant parts and plant constituents in the processed or unprocessed states, animal bodies, including living bodies, and body parts, constituents and metabolic products of human and animal in processed or unprocessed state, microorganisms including viruses and their constituents or metabolic products. The group of the pharmaceuticals also includes, for example, sera and vaccines. In the context of this application, pharmaceuticals also refer to medical appliances, assistants or dressing materials.

In the context of this application, bodycare compositions are compositions for the care of the human body. The group of these compositions includes, for example, detergents for skin and hair, bath additives, soaps, etc. The compositions for aesthetic improvement of the human body, which are referred to as cosmetics, should be distinguished from the bodycare compositions.

In the context of the present application, the group of the agrochemical assistants includes, in particular, animal foods, crop protection compositions or fertilizers. Active substances used with preference are the insecticides, fungicides, herbicides, acaricides or nematocides, and also the crop growth regulators.

Preferred fungicides are triadimefon, tebuconazol, prochloraz, triforin, tridemorphq propiconazol, pirimicarb, iprodione, metalaxyl, bitertanol, eiprobenfos, flusilazole, fosetyl, propyzamide, chlorothalonil, dichlone, mancozeb, anthraquinone, maneb, vinclozolin, fenarimol, bendiocarb, captafol, benalaxyl, thiram. Preferred herbicides are quizalofop and its derivatives, acetochlor, metolachlor, imazapur and imazapyr, glyphosate and gluphosinate, butachlor, acifluorfen, oxyfluorfen, butralin, fluazifop-butyl, bifenox, bromoxynil, ioxynil, diflufenican, phenmedipham, desmedipham, oxadiazon, mecoprop, MCPA, MCPB, linuron, isoproturon, flamprop and its derivatives ethofumesate, diallate, carbetamide, alachlor, metasulfuron, chlorsulfuron, chlorpyralid, 2,4-D, tribufos, triclopyr, diclofop-methyl, sethoxydim, pendimethalin, trifluralin, ametryn, chloramben, amitrole, asulam, dicamba, bentazone, atraizin, cyanazin, thiobencarb, prometryn, 2-(2-chlorobenzyl)-4,4-dimethyl-1,2-oxazolidin-3-one, fluometuron, napropamide, paraquat, bentazol, molinat, propachlor, imazaquin, metribuzin, tebuthiuron, oryzalin, flupoxam. Insecticides or nematicides used with preference are ebufos, carbosulfan, amitraz, vamidothion, ethion, triazophos, propoxur, phosalone, permethrin, cypermethrin, parathion, methylparathion, diazinon, methomyl, malathion, lindan, fenvalerat, ethoprophos, endrin, endosulfan, dimpthoat, dieldrin, dicrotophos, dichlorprop, dichlorvos, azinphos and its derivatives, aldrin, cyfluthrin, deltamethrin, disulfoton, chlordimeform, chlorpyrifos, carbaryl, dicofol, thiodicarb, propargite, demeton, phosalone. The group of the preferred crop growth regulators includes gibberellic acid, ethrel or ethephon, cycocel, chlormequat, ethephon, mepiquat.

Adhesives are (according to DIN 16 920, 06/1981) nonmetallic substances which bond joining parts by surface adhesion and inner strength (cohesion). "Adhesive" is a generic term and also includes other common terms for adhesive types which are selected according to physical, chemical or processing technology aspects, for example, glue, paste, dispersion adhesives, solvent adhesives, reaction adhesives, contact adhesives. The names of the adhesives often contain additions to indicate base substances (for example, starch paste, synthetic resin glue, skin glue), process conditions (for example, cold glues, heat-sealing or melt adhesives, assembly glue), end use (for example, paper adhesives, wood glues, metal adhesives, wallpaper pastes, rubber adhesives) and supply form (for example, liquid adhesive, glue solution, glue powder, panel glue, glue jelly, adhesive cement, adhesive tape, adhesive film).

Adhesives are based predominantly on organic compounds, but inorganic adhesives are also used. DIN 16 920 divides the adhesive types into physically setting adhesives (glues, pastes, solvent adhesives, dispersion adhesives, plastisol adhesives and hot-melt adhesives) and chemically setting adhesives (for example, cyanoacrylate adhesives). The physically setting adhesives may be solvent-free (hot-melt adhesive) or solvent-containing. They set through change in the state of matter (liquid→solid) or by evaporation of the solvent before or during the adhesion process and generally have one component.

The chemically setting one-component or multicomponent reaction adhesives may be based on all polyreactions: two-component systems composed of epoxy resins and acid anhydrides or polyamines react by polyaddition mechanisms, cyanoacrylates or methacrylates react by polymerization mechanisms, and systems based on amino resins or phenolic resins react by polycondensation mechanisms.

The range of monomers or polymers usable as adhesive raw materials is widely variable and makes possible adhesive bonds of almost all materials. A problem in many cases is the adhesive bonding of plastics.

The dominant aim of current adhesive developments is the shift (necessary for ecological and economic reasons) from systems comprising organic solvents to solvent-free systems or those comprising water as the solvent.

Speciality adhesives are the so-called conductive adhesives composed of synthetic resins with electrically conductive metal powder or pigments as additives. The development of so-called antiadhesives which are intended to prevent the adhesion of substrates (paper) to correspondingly impregnated surfaces can be regarded as a by-product of adhesives research. Adhesives are also produced by living organisms. A multitude of microorganisms generate adhesives in order to stick to a wide variety of different substrates (even to moist substrates, for example, to teeth). A particularly interesting example of organisms which produce adhesive is that of representatives of the Balanids (suborder Cirrepedia), which are capable of performing very durable and strong adhesive bonds underwater and thus attaching themselves to ships' hulls. Attempts are being made in dental medicine to utilize Balanid adhesives, which consist of proteins crosslinked with quinones, for dental repairs. Adhesive bonds of moist substrates and bonding underwater are problems in adhesives research which have in many cases still not been solved satisfactorily to date.

The packaging process according to the invention is suitable in principle for all aforementioned adhesives, which requires chemical compatibility of the fillings with the packaging materials surrounding them. The packaging process according to the invention is of particular interest, for example, for water-containing or water-soluble adhesives or glues which, before use, are stirred into water or aqueous solutions. This group of adhesives includes, for example, the wallpaper pastes.

"Building materials" is a collective term for the usually inorganic substances used in building. The natural building materials include, for example, natural stone, wood, gravel, grit and sand. The synthetic building materials include slags, ceramic building materials such as clinker, brick and ceramics, glass, plastics, reinforced steel, etc.; the binders (better: building binders) include gypsum, lime, mortar, cement and the products produced with these, such as concrete and the like. These also include insulation materials such as glass-wool, rockwool, foams as sound-deadening and heat-insulating substances, and also, if appropriate, for fire protection, the so-called building assistants, sealants such as asphalt, adhesive materials and the building protectants, wood protectants and flame retardants. Of particular interest in the context of the present application are the building assistants, i.e. the substances used as processing aids and for changing the properties of binders, such as liquefiers, retardants and accelerants, air pore formers, sealants, building emulsions as adhesive bonds, etc.

"Dyes" is a collective term for colorants soluble in solvents and/or binders, and also the insoluble pigments, which are inferior to the dyes in number, structural variety and usually also in illuminating power. For instance, only about 100 pure pigments are known, but many tens of thousands of different dyes, of which, however, only from 6,000 to 7,000, and even only 500 in more significant amounts, are utilized industrially; typically, the dyes also include the optical brighteners. A distinction is firstly drawn between natural and synthetic dyes according to the origin. The former include, for example, the anthocyans which are not industrially usable in all cases, alizarin, betalaines, logwood, chlorophyll, cochenille, curcuma, hemoglobin, indigo, kermes, madder, litmus, annatto, orcein, antique purple, safflower, etc. Better known synthetic dyes are, for example, aniline blue, aniline black, anthracene blue, Bismarck brown, chrysoidine, ciba blue, fuchsine, hydron blue (Hydron® Blue R, 3R, G), immedial black (Immedial® and Immedial light dyes), congo red, crystal violet, malachite green, methylene blue, methyl orange, methyl violet, Variamin® blue, victoria blue. Among the natural dyes, only alizarin and indigo are also produced synthetically in industry; all remaining synthetic dyes are creations of the chemical industry.

In the context of the present application, substance classes particularly preferred as the dye are the azo dyes, azine dyes, anthraquinone dyes, acridine dyes, cyanine dyes, oxazine dyes, polymethine dyes, thiazine dyes and/or triarylmethane dyes. Apart from by their chemical constitution, preferred dyes can also be characterized by their behavior toward the fiber or the dyeing technique to be employed without taking into account the constitution. Particularly suitable in the context of the present application are accordingly basic or cationic dyes, mordant dyes, direct dyes, dispersion dyes, development dyes, vat dyes, metal complex dyes, reactive dyes, acid dyes, sulfur dyes and/or substantive dyes.

In the context of the present application, foods are regarded as being substances which are intended to be consumed by the human in the unchanged, prepared or processed state; the foods also include the food additives which are added to foods to influence their properties or to achieve certain properties or effects. These food additives include, for example, the dyes and the preservatives, but also vitamins or trace elements. In addition to their natural constituents, which also include those having possible harmful effects, the foods may comprise further substances which may be of natural or synthetic origin, and which may pass into the food intentionally or unintentionally; in the latter case, they may be of anthropogenic or natural origin.

Apart from the water-soluble or water-dispersible packaging materials mentioned above, suitable materials for packaging the active substances from the group of the pharmaceuticals, bodycare compositions, agrochemical assistants, adhesives, building materials, dyes or foods also include, in particular, the cellulose derivatives, particularly methylcellulose, hydroxypropylcellulose, hydroxypropylmethylcellulose, hydroxyethylcellulose, sodium carboxymethylcellulose (cellulose glycolate), ethylcellulose, cellulose acetate phthalate and/or hydroxypropylmethylcellulose phthalate. Preferred packaging materials are also the polyacrylates and polymethacrylates, for example, Eudragit® E, Eudragit® E 30 D, Eudragit® L, Eudragit® L 30 D, Eudragit® S, Eudragit® RL and Eudragit® RS. Preferred packaging materials from the group of the vinyl polymers are polyvinylpyrrolidone (PVP) and polyvinyl acetate phthalate (PVAP). A further preferred water-soluble packaging material is shellac.

The aforementioned water-soluble or water-dispersible packaging materials may be used in pure form, with addition of assistants such as plasticizers or stabilizers, or in mixtures or as composite materials.

The invention claimed is:

1. A process for producing a composition in a water-soluble package comprising the steps of a) reshaping a water-soluble material to form a vessel;

b) partially filling the vessel with a filling selected from the group consisting of washing and cleaning compositions, cosmetics, pharmaceuticals, body care compositions, agrochemical assistants, adhesives, surface treatment compositions, building materials, dyes and foods;

c) applying a water-soluble film web with orifices to the partly filled vessel;

d) placing the vessel with the film web applied to the vessel into a reduced-pressure chamber and forming a reduced pressure in this chamber;

e) sealing the partly filled vessel and the film web so that air can no longer pass through the sealed orifices of the film web applied in step c) into the vessel;

f) releasing the reduced pressure in the reduced-pressure chamber to form a first filled receiving chamber formed by the vessel and the film web sealed in step e) and a second unfilled receiving chamber which substantially corresponds to the unfilled residual volume of the vessel formed in step a);

g) partially or entirely filling this residual volume with a filling selected from the group consisting of the washing and cleaning compositions, cosmetics, pharmaceuticals, body care compositions, agrochemical assistants, adhesives, surface treatment compositions, building materials, dyes and foods;

h) applying a water-soluble film web to the at least partly filled vessel; and i) finishing the sealed and filled vessel.

2. The process as claimed in claim 1, wherein the fill level of the partially filled vessel is between 10 and 95% by volume.

3. The process as claimed in claim 2, wherein the fill level of the partially filled vessel is between 40 and 80% by volume.

4. The process as claimed in claim 1, wherein the reduced pressure being formed is between −100 and −1,013 mbar.

5. The process as claimed in claim 1, wherein the vessel produced in step a) has a wall thickness below 800 μm.

6. A process for producing a composition in a water-soluble package comprising the steps of a) reshaping a water-soluble material to form a vessel;

b) partially filling the vessel with a filling selected from the group consisting of washing and cleaning compositions, cosmetics, pharmaceuticals, body care compositions, agrochemical assistants, adhesives, surface treatment compositions, building materials, dyes and foods;

c) applying a water-soluble film web with orifices to the partly filled vessel;

d) placing the vessel with the film web applied to the vessel into a reduced-pressure chamber and forming a reduced pressure in this chamber;

e) sealing the party filled vessel and the film web so that air can no longer pass through the sealed orifices of the film web applied in step c) into the vessel;

f) releasing the reduced pressure in the reduced-pressure chamber to form a first filled receiving chamber formed by the vessel and the film web sealed in step e) and a second unfilled receiving chamber which substantially corresponds to the unfilled residual volume of the vessel formed in step a);

g) partially or entirely filling this residual volume with a filling selected from the group consisting of the washing and cleaning compositions, cosmetics, pharmaceuticals, body care compositions, agrochemical assistants, adhesives, surface treatment compositions, building materials, dyes and foods;

h) applying a water-soluble film web to the at least partly filled vessel;

i) placing the vessel with the film web applied to the vessel into a reduced-pressure chamber and forming a reduced pressure in this chamber;

j) sealing the partly filled vessel and the film web so that air can no longer pass through the sealed orifices of the film web applied in step h) into the vessel;

k) releasing the reduced pressure in the reduced-pressure chamber to form a first filled receiving chamber formed by the vessel and the film web sealed in step j) and an unfilled receiving chamber;

l) partially or entirely filling this residual volume with a filling selected from the group consisting of the washing and cleaning compositions, cosmetics, pharmaceuticals, body care compositions, agrochemical assistants, adhesives, surface treatment compositions, building materials, dyes and foods;

m) applying a water-soluble film web to the at least partly filled vessel; and n) finishing the sealed and filled vessel.

7. A process for producing a composition in a water-soluble package comprising the steps of a) reshaping a water-soluble material to form a vessel;

b) partially filling the vessel with a filling selected from the group consisting of washing and cleaning compositions, cosmetics, pharmaceuticals, body care compositions, agrochemical assistants, adhesives, surface treatment compositions, building materials, dyes and foods;

c) applying a water-soluble film web with orifices to the partly filled vessel;

d) placing the vessel with the film web applied to the vessel into a reduced-pressure chamber and forming a reduced pressure in this chamber;

e) sealing the partly filled vessel and the film web so that air can no longer pass through the sealed orifices of the film web applied in step c) into the vessel;

f) releasing the reduced pressure in the reduced-pressure chamber to form a first filled receiving chamber formed by the vessel and the film web sealed in step e) and a second unfilled receiving chamber which substantially corresponds to the unfilled residual volume of the vessel formed in step a);

g) partially or entirely filling this residual volume with a filling selected from the group consisting of the washing and cleaning compositions, cosmetics, pharmaceuticals, body care compositions, agrochemical assistants, adhesives, surface treatment compositions, building materials, dyes and foods;

h) applying a water-soluble film web to the at least partly filled vessel;

i) placing the vessel with the film web applied the vessel into a reduced-pressure chamber and forming a reduced pressure in this chamber;

j) sealing the partly filled vessel and the film web so that air can no longer pass through the sealed orifices of the film web applied in step h) into the vessel;

k) releasing the reduced pressure in the reduced-pressure chamber to form a first filled receiving chamber formed by the vessel and the film web sealed in step j) and an unfilled receiving chamber; and l) finishing the sealed and filled vessel.

* * * * *